US009809416B1

(12) United States Patent
Spruell

(10) Patent No.: US 9,809,416 B1
(45) Date of Patent: Nov. 7, 2017

(54) CABLE REEL LENGTH CALCULATOR

(71) Applicant: Southwire Company, LLC, Carrollton, GA (US)

(72) Inventor: Stephen Lee Spruell, Woodland, AL (US)

(73) Assignee: Southwire Company, LLC, Carrollton, GA (US)

( * ) Notice: Subject to any disclaimer, the term of this patent is extended or adjusted under 35 U.S.C. 154(b) by 694 days.

(21) Appl. No.: 14/105,429

(22) Filed: Dec. 13, 2013

Related U.S. Application Data

(60) Provisional application No. 61/737,773, filed on Dec. 15, 2012.

(51) Int. Cl.

| | |
|---|---|
| ***G01B 7/00*** | (2006.01) |
| ***G01B 15/00*** | (2006.01) |
| ***B65H 63/08*** | (2006.01) |
| *B65H 54/28* | (2006.01) |

(52) U.S. Cl.
CPC ..... *B65H 63/08* (2013.01); *B65H 54/2854* (2013.01); *B65H 54/2878* (2013.01); *B65H 63/082* (2013.01); *B65H 63/086* (2013.01); *B65H 2557/24* (2013.01)

(58) Field of Classification Search
CPC .... B65H 63/08; B65H 63/082; B65H 63/086; B65H 61/00; B65H 54/2854; B65H 54/2857; B65H 54/286; B65H 54/2866; B65H 54/2869; B65H 54/2875;
(Continued)

(56) References Cited

U.S. PATENT DOCUMENTS 4,244,539 A * 1/1981 Taneda ..... B65H 54/2851 242/157 R
4,676,442 A 6/1987 Tholander et al.
(Continued)

FOREIGN PATENT DOCUMENTS

JP 59001021 1/1984

OTHER PUBLICATIONS

Cirris Systems Corp., CirrisConnect, Cable/Harness Testing Made Easy, <http://www.cirris.com/support/news/aug_2008.html> Aug. 2008.

(Continued)

*Primary Examiner* — David M Gray
*Assistant Examiner* — Geoffrey T Evans
(74) *Attorney, Agent, or Firm* — Hartman & Citrin LLC

(57) ABSTRACT

The present disclosure is generally directed towards calculating a remaining length of a cable on a cable reel. Generally, a first distance between a top edge of a first flange of the cable reel and a top portion of the cable remaining on the cable reel is received at a processor. A winding characterization indicating a configuration of the cable wound on the cable reel is also received at the processor. Dimensions of the cable reel are also received at the processor and include: a diameter of the first flange, a cable reel traverse distance, and a diameter of a drum of the cable reel. The cable reel traverse distance indicates a distance between the first and second flanges of the cable reel. The remaining length of the cable on the cable reel is calculated based on the first distance, the winding characterization, and the dimensions of the cable reel.

20 Claims, 16 Drawing Sheets

(58) Field of Classification Search
CPC ..... B65H 54/2878; B65H 2551/20; B65H 2551/21; B65H 2557/24
See application file for complete search history.

(56) References Cited

U.S. PATENT DOCUMENTS

| | | | | | |
|---|---|---|---|---|---|
| 4,953,797 | A * | 9/1990 | Markow | H02K 15/0457 | 242/437.1 |
| 5,153,625 | A | 10/1992 | Weber | | |
| 5,209,414 | A * | 5/1993 | Clemens | B65H 54/10 | 242/478.2 |
| 5,247,323 | A | 9/1993 | Weber | | |
| 5,389,992 | A | 2/1995 | Weber | | |
| 5,564,637 | A * | 10/1996 | Berthold | B65H 54/2803 | 242/157.1 |
| 5,590,846 | A * | 1/1997 | Dekel | B65H 54/2878 | 242/478.2 |
| 5,809,358 | A | 9/1998 | Weber | | |
| 6,409,117 | B2 | 6/2002 | Petersen et al. | | |
| 6,921,044 | B2 | 7/2005 | Graber et al. | | |
| 7,370,823 | B2 * | 5/2008 | Lammermann | B65H 54/286 | 242/397.2 |
| 7,945,549 | B2 | 5/2011 | Galgano | | |
| 2009/0008494 | A1 | 1/2009 | Maley | | |
| 2012/0062154 | A1 * | 3/2012 | Chiao | H02K 3/47 | 318/161 |

OTHER PUBLICATIONS

Ingersoll Rand Drum Capacity Estimator, <http://www.ingersollrandproducts.com/lifting/winches/drum.htm> [Accessed Nov. 8, 2012].

Cirris, "How Much Wire is on the Spool?" <http://www.cirris.com/testing/resistance/spool-measure.html> [Accessed Nov. 8, 2012].

Dayton, Korin, "How to Calculate Wire Rope Drum Capacity in Meters," <http://www.ehow.com/how_7829709_calculate-rope-drum-capacity-meters.html> [Accessed Nov. 8, 2012].

Catskill Supply, Inc., Psiber Model 50—Cable Length Tester <http://www.catskillsupply.com/toolsct50.html> [Accessed Nov. 8, 2012].

* cited by examiner

CABLE REEL LENGTH CALCULATOR

CROSS-REFERENCE TO RELATED APPLICATIONS

The present invention claims the benefit of U.S. Provisional Application Ser. No. 61/737,773, filed Dec. 15, 2012, which is expressly incorporated herein by reference in its entirety.

BACKGROUND

This application relates generally to a cable reel length calculator platform. More particularly, the disclosure provided herein relates to calculating the remaining length of cable when, in some embodiments, some portion of the cable has been used. According to some embodiments, the cable includes a conductor or an assembly of cables and/or cable conductors, wire, rope or the like, on a cable reel holding the same.

Over the past several years, the use of smartphones and other portable Internet-enabled devices has increased drastically. Thus, many consumers today rely upon smartphones or other portable computing platforms to make calculations of complex mathematical formulas. Further, these portable electronic devices allow for more user-friendly interaction with programs on these portable computing platforms by leading a user step-by-step through the process of entering data and by determining which means are most suitable to collect data for entering into the computing platforms.

There has long existed a need for contractors to determine how much cable, conductor cable, wire or rope exists on a cable reel after a portion has been used at a job site or to determine how much cable, wire or rope exists on a cable reel where the original length is unknown. Complex mathematical calculations to determine a remaining wire length on a cable reel require many dimensions to be directly and accurately measured and input for calculation. This often leaves users with little flexibility to collect different available measurements if some measurements are not easily obtainable.

SUMMARY

It should be appreciated that this Summary is provided to introduce a selection of concepts in a simplified form that are further described below in the Detailed Description. This Summary is not intended to be used to limit the scope of the claimed subject matter.

In one embodiment disclosed herein, a method for calculating a remaining length of a cable on a cable reel is provided. A first distance between a top edge of a first flange of the cable reel and a top portion of the cable remaining on the cable reel are obtained. Also, a characterization from a plurality of characterizations is obtained. The characterization indicates how the cable is wound on the cable reel. Further, dimensions of the cable reel are obtained. The dimensions may include a diameter of the first flange, a cable reel traverse distance between the first flange and a second flange of the cable reel, and a diameter of a drum of the cable reel. The remaining length of the cable on the cable reel is generated based on the first distance, the characterization of how the cable is wound on the cable reel, and the dimensions of the cable reel.

In another embodiment disclosed herein, a method that calculates a remaining length of material on a cable reel is provided. A first distance between a top edge of a first flange of the cable reel and a top portion of the material remaining the cable reel, a predetermined factor corresponding to an uneven characterization of how the material is wound on the cable reel, and dimensions of the cable reel, including a diameter of the first flange, a reel traverse distance between the first flange and a second flange of the cable reel, and a diameter of a drum of the cable reel are obtained. The remaining length of the material on the cable reel is generated based on the quantity of cables, the first distance, the predetermined factor corresponding to the uneven characterization of how the material is wound, and the cable reel dimensions.

In another embodiment disclosed herein, a computer storage medium having computer-executable instructions stored thereon that, when executed by a processor, cause the processor to perform operations including obtaining a quantity of cables on the cable reel, a first distance between a top edge of a flange of the cable reel and a top portion of remaining cable on the cable reel, a characterization of the cable winding on the cable reel, and cable reel dimensions including a cable reel flange diameter, a cable reel traverse distance between adjacent cable reel flanges, a cable reel drum diameter is provided. The instructions further cause the processor to perform operations that generate a remaining length of cable on the cable reel based on the quantity of cables, the first distance, the characterization of the cable winding, and the cable reel dimensions, and provide the remaining length of cable on the cable reel to the user device.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The accompanying drawings, which are incorporated in and constitute a part of this disclosure, illustrate various embodiments of the present invention. In the drawings.

DESCRIPTION

Figure 1:
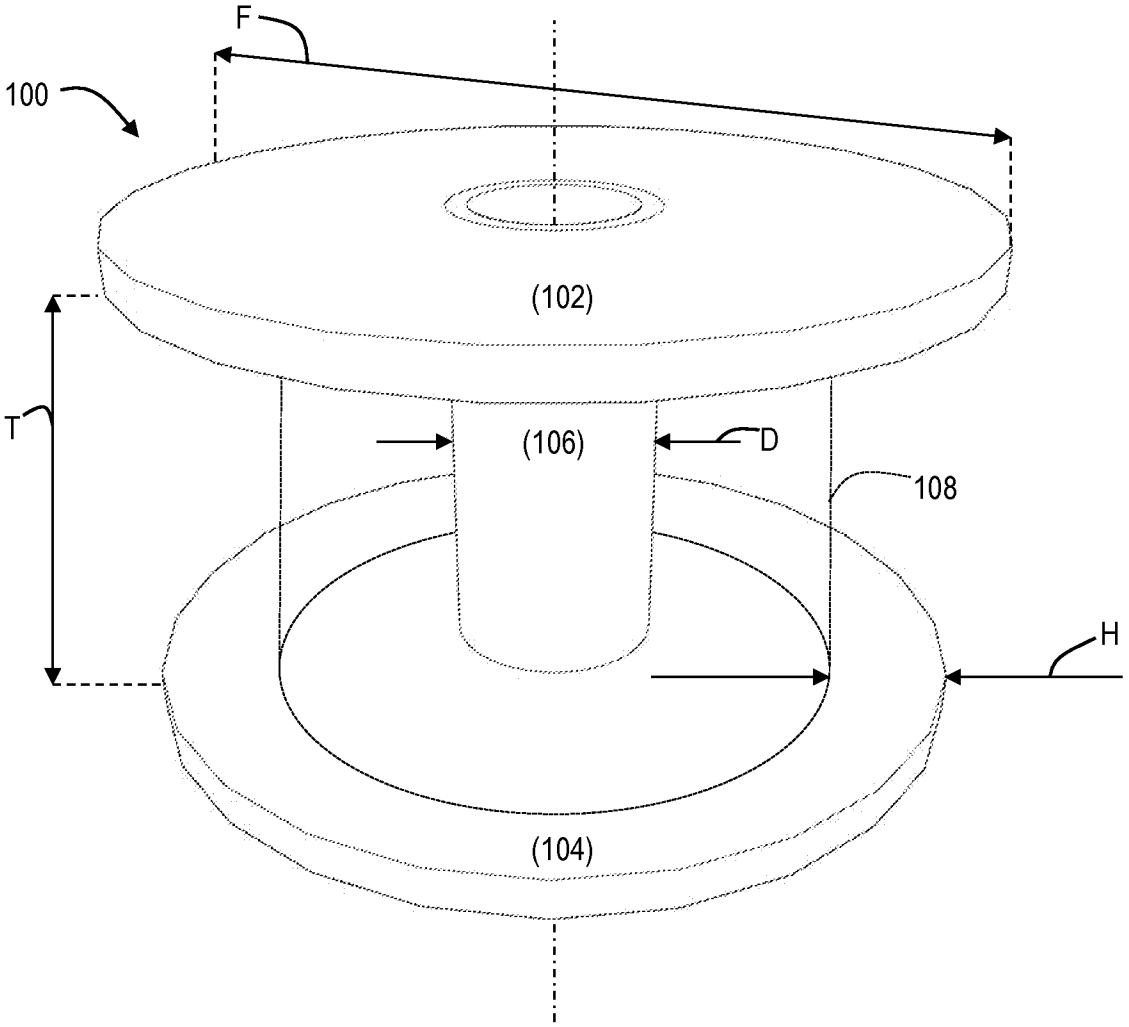
FIG. 1 illustrates a cable reel and measurement indicators for particular dimensions needed for the embodiments presented herein.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Figure 2:
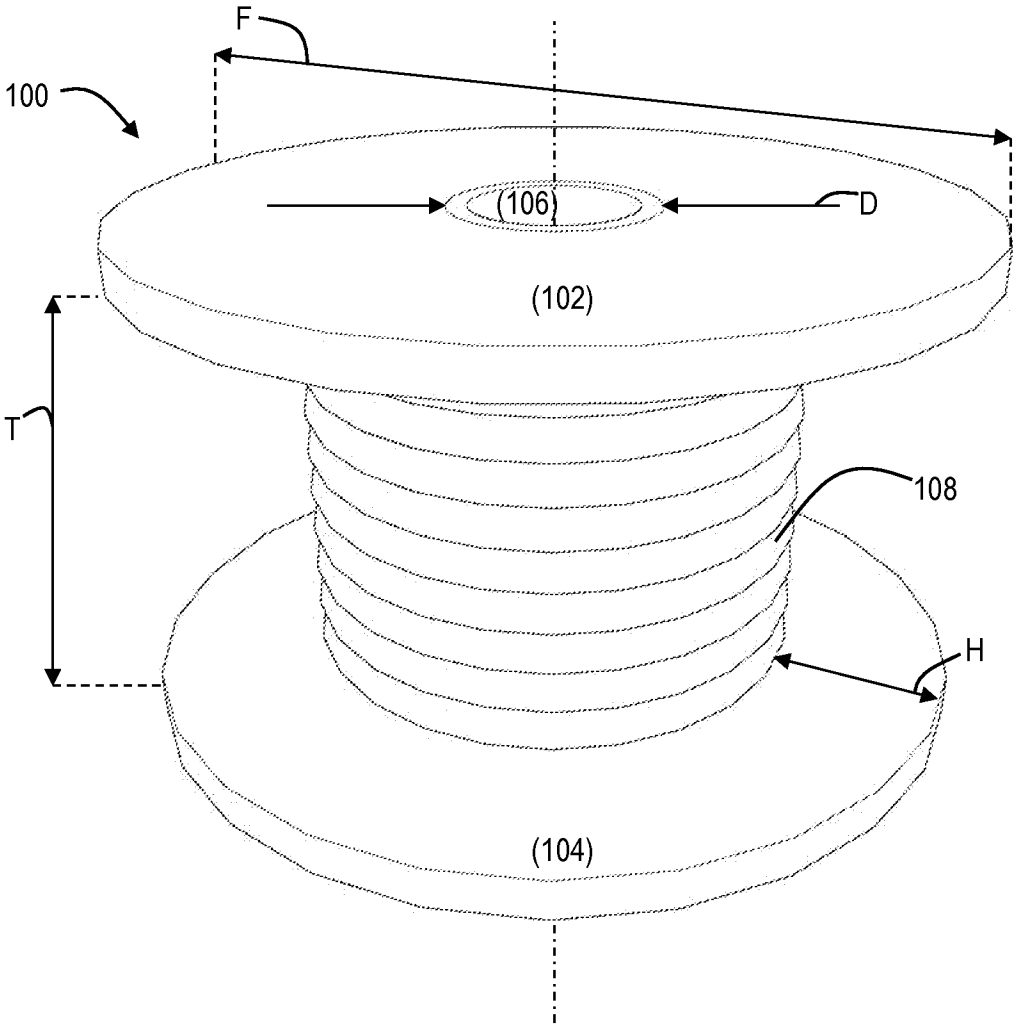
FIG. 2 illustrates the cable reel of FIG. 1 being partially filled with cable measurement indicators for particular dimensions needed for the embodiments presented herein.
Figure 3:
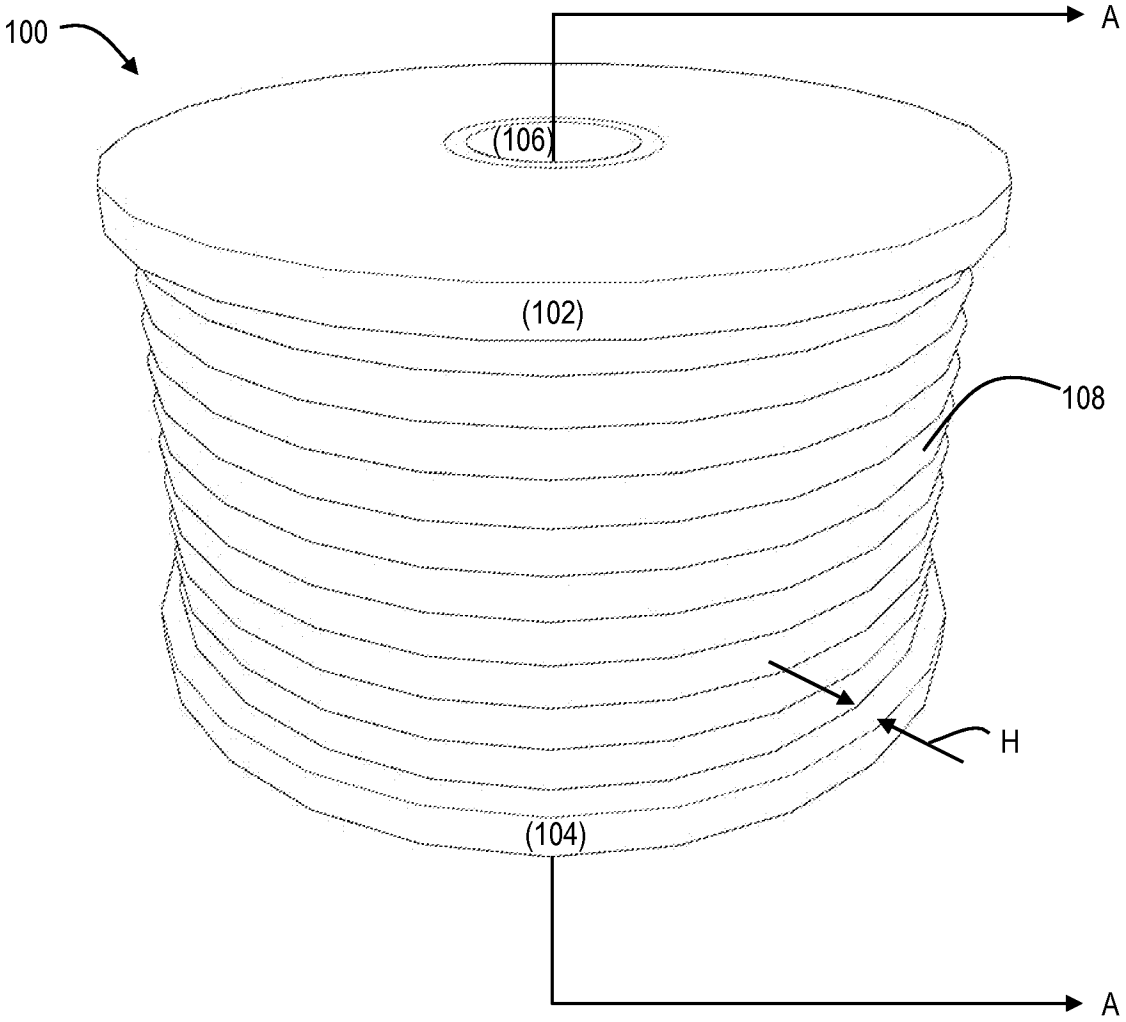
FIG. 3 illustrates the cable reel of FIG. 1 being mostly filled with cable directed toward the embodiments presented herein.

FIG. 1 illustrates a cable reel 100 and measurement indicators for particular dimensions that may be used to determine a remaining amount of cable on the cable reel 100. The cable reel 100 includes two oppositely disposed flanges 102 and 104 each having a diameter F which, according to some embodiments, is the same for both flanges. A drum 106 disposed between the flanges 102 and 104 has an outer diameter D. The drum 106 further includes a traverse distance T indicating a distance between the inside edges of flanges 102 and 104. A remaining cable height H measures the distance from an outer edge of the flange 102/104 to the top of a remaining portion of cable 108 (illustrated by broken lines) on the cable reel 100. FIG. 2 illustrates the cable reel 100 of FIG. 1 being partially filled with the cable 108. FIG. 3 illustrates the cable reel 100 of FIG. 1 being mostly filled with the cable 108 as the remaining cable height H approaches the outer edge of the flanges 102/104. The cable 108 may include cable including a conductor, cable including an assembly of cables and/or cable conductors, wire, rope or the like.

Figure 4:
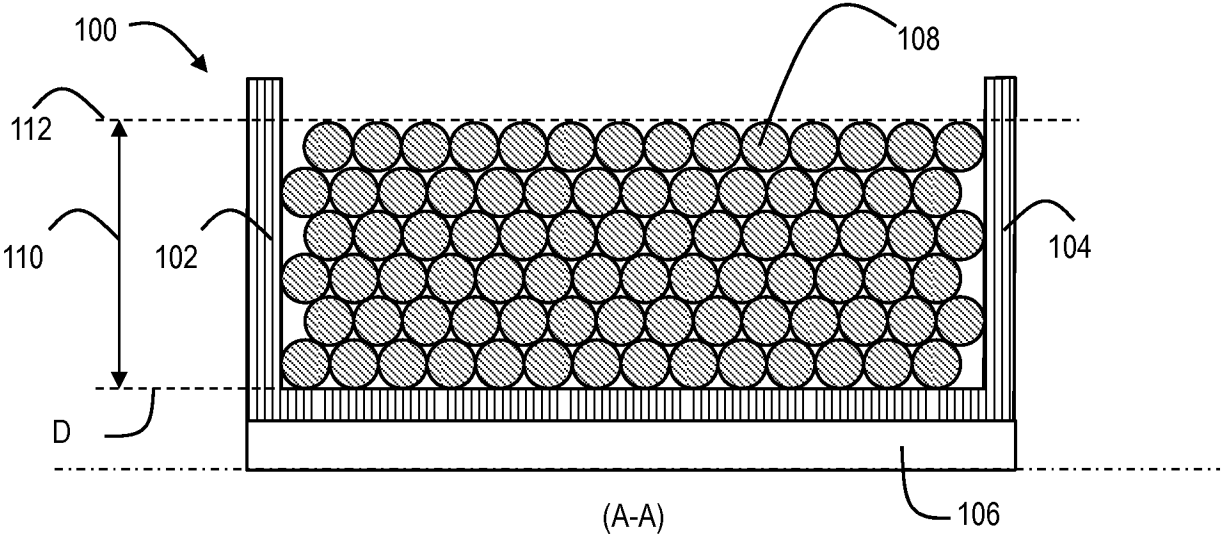
FIG. 4 illustrates a cross sectional representation of line (A-A) of FIG. 3 including an even cable winding on the cable reel.

FIG. 4 illustrates a cross sectional representation of line (A-A) of FIG. 3 representing the cable 108 having an even cable winding on the drum 106 of the cable reel 100 between both of the flanges 102/104. In this configuration, the cable 108 has an outer wound surface 112 at a height 110 with respect to the outer diameter D of the drum 106. The even cable winding of the cable 108 on the drum 106 of the cable reel 100 illustrates the most efficient use of the volume of the cable reel 100 by minimizing the spaces made between adjacent cable sections of the cable, the outer diameter D of the drum 106 and the flanges 102/104.

Figure 5:
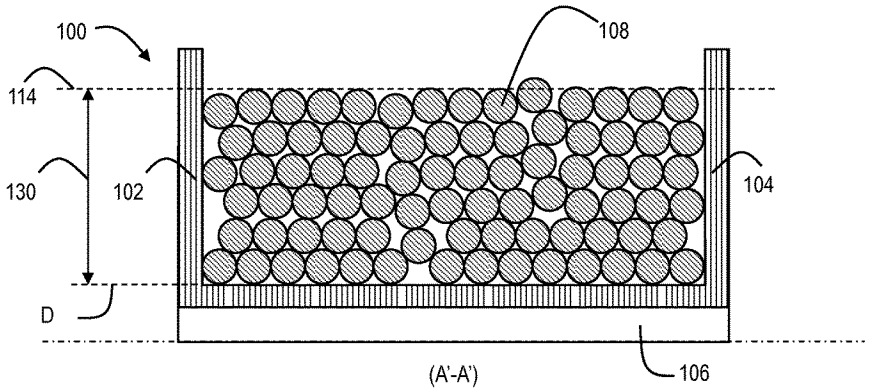
FIG. 5 illustrates an alternative cross sectional representation (A'-A') similar to FIG. 3 including an uneven cable winding on the cable reel.

FIG. 5 illustrates an alternative cross sectional representation (A'-A') similar to FIG. 3 representing the cable 108 having an uneven cable winding on the drum 106 of the cable reel 100 between both of the flanges 102/104. The uneven cable winding of the cable 108 around the cable reel 100 illustrates less efficient use of the volume of the cable reel 100 by failing to minimize the spaces made between adjacent cable sections of the cable, the outer diameter D of the drum 106 and the flanges 102/104. In this configuration, the cable 108 has an outer wound surface 114 at a height 130 with respect to the outer diameter D of the drum 106. Given this configuration, since the cable 108 of FIG. 4 is the same as the cable of FIG. 5, thus having the same length and diameter, the uneven cable winding of the cable in FIG. 5 would have a greater height 130 of the outer wound surface 114 than the height 110 of the outer wound surface 112 of the cable illustrated in FIG. 4 due to increased spaces between adjacent cable sections, the outer diameter D of the drum 106 and the flanges 102/104 of the cable in FIG. 5.

Figure 6:
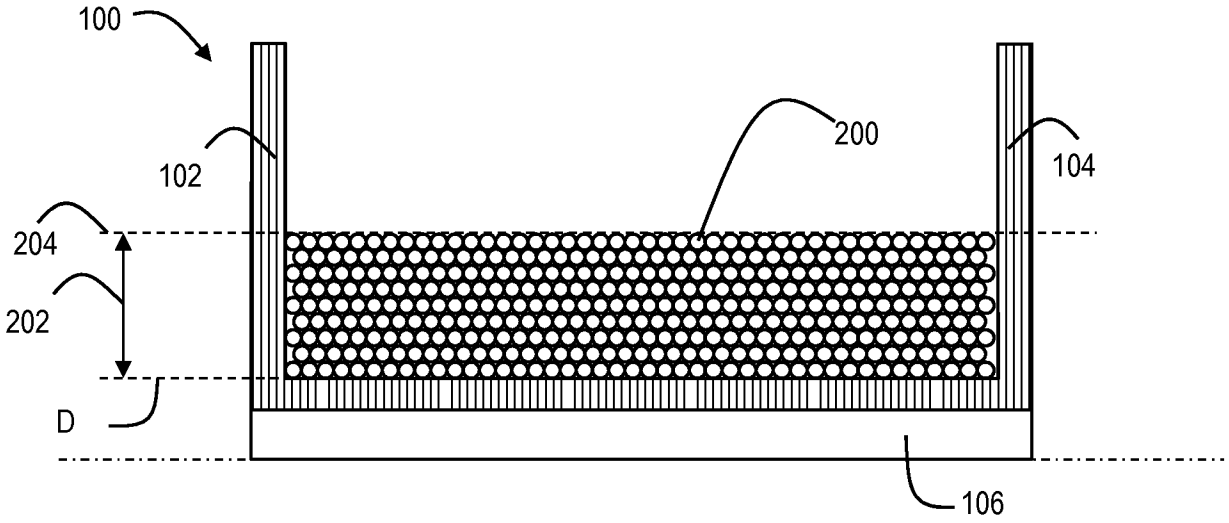
FIG. 6 illustrates another embodiment of a cable having a different outer diameter than FIGS. 4-5, where the cable has an even cable winding on the cable reel.

FIG. 6 illustrates another embodiment of a cross section of a cable 200 on the cable reel 100 where the cable 200 has a different outer diameter than the cable 108 of FIGS. 4-5. The cable 200 has an even cable winding on the cable reel 100 similar to FIG. 4, where the even cable winding of the cable 200 illustrates the most efficient use of the volume of the cable reel 100 by minimizing the spaces made between adjacent cable sections of the cable, the outer diameter D of the drum 106 and the flanges 102/104. In this configuration, the cable 200 has an outer wound surface 204 at a height 202 with respect to the outer diameter D of the drum 106.

Figure 7:
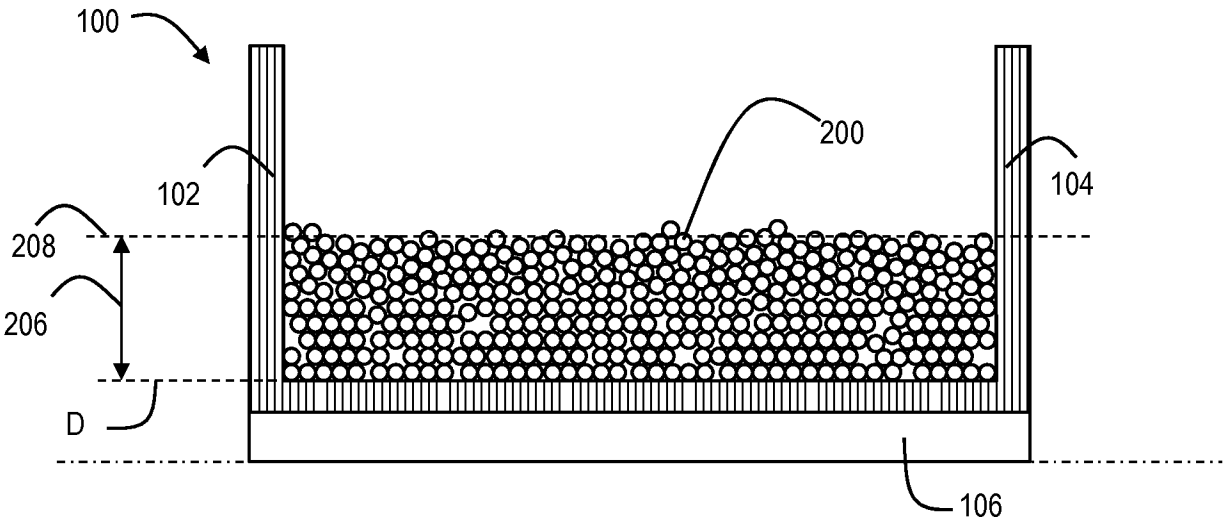
FIG. 7 illustrates an alternative embodiment of the cable illustrated in FIG. 6, where the cable has an uneven cable winding on the cable reel.

FIG. 7 illustrates an alternative embodiment of the cable 200 illustrated in FIG. 6, where the cable 200 has an uneven cable winding on the drum 106 of the cable reel 100 between both of the flanges 102/104. The uneven cable winding of the cable 200 around the cable reel 100 illustrates less efficient use of the volume of the cable reel 100 by failing to minimize the spaces made between adjacent cable sections of the cable, the outer diameter D of the drum 106 and the flanges 102/104. In this configuration, the cable 200 has an outer wound surface 208 at a height 206 with respect to the outer diameter D of the drum 106. Given this configuration, since the cable 200 of FIG. 6 is the same as the cable of FIG. 7, thus having the same length and diameter, the uneven winding of cable 200 in FIG. 7 would have a greater outer wound surface height 206 of the outer wound surface 208 than the height 202 of the outer wound surface 204 of the cable illustrated in FIG. 6 due to increased spaces between adjacent cable sections, the outer diameter of the drum 106 and the flanges 102/104 of the cable in FIG. 7.

The comparison made between FIGS. 4-5 and FIGS. 6-7 illustrates that the magnitude and distribution of spaces between adjacent cable sections, the outer diameter of the drum 106 and the flanges 102/104 of the uneven cable windings may be dependent upon the diameter of the cable and a type of the cable, where the type of the cable may include, for example, twisted conductor cable having a helical profile, cables with different insulator materials, different shaped conductor cables having non-circular cross sections, (like flat ribbon-like conductors), the texture or roughness of the outer surface of the cable, the winding tension of the cable when wound on the cable reel, the outward deflection of the flanges when cable is wound onto the cable reel, and multiple twisted cables that are preassembled together before being wound on the cable reel. Each of these representative parameters may contribute to how an uneven cable winding of a cable around a drum of a cable reel may affect how the spaces between adjacent cable sections of the cable, the drum of the cable reel and flanges of the cable reel are generated. Additionally, each of these representative parameters may contribute to how an uneven cable winding of an electrical cable conductor around a drum of a cable reel may affect how the spaces between adjacent cable sections of the electrical cable conductor, the drum of the cable reel and flanges of the cable reel are generated.

Figure 8:
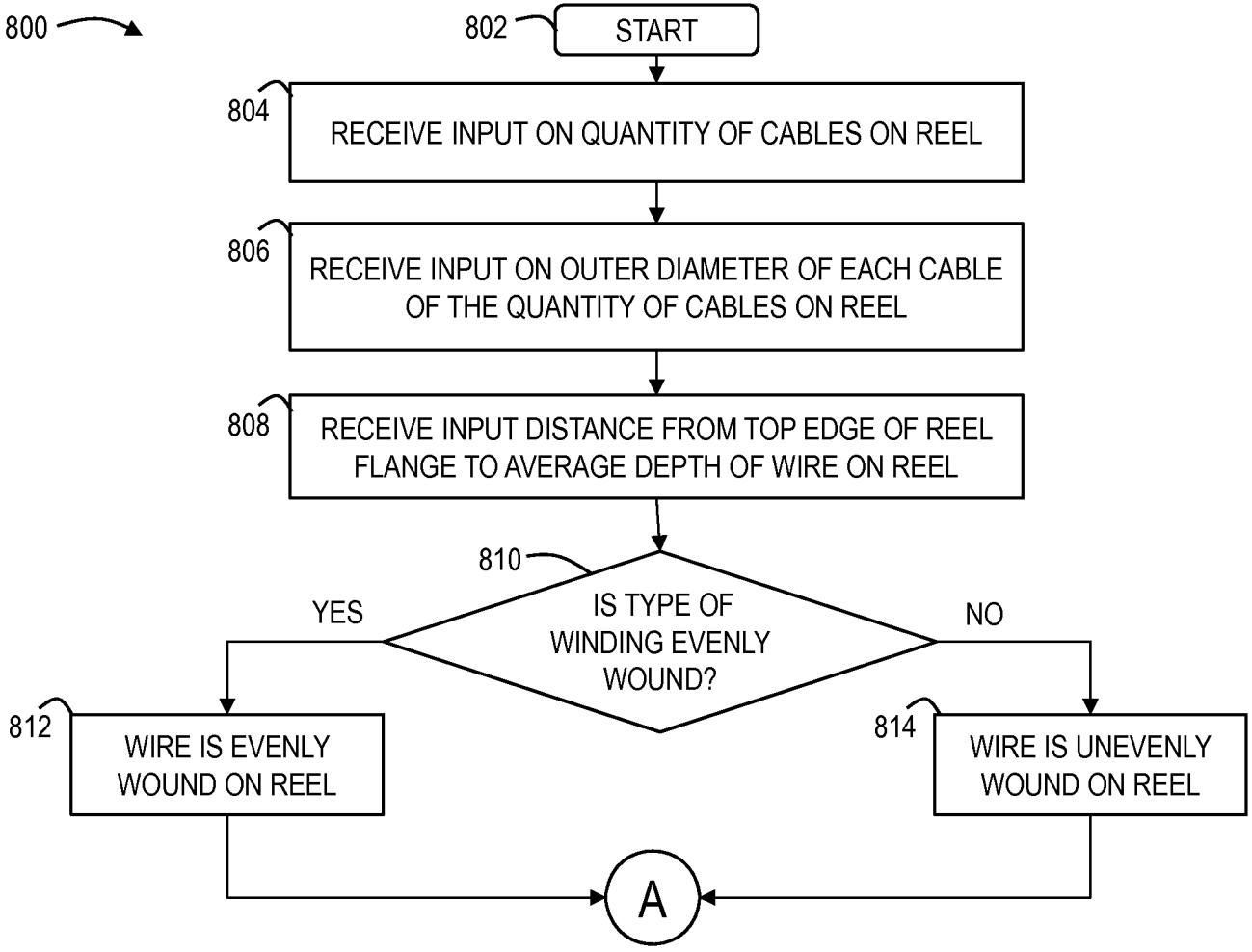
FIG. 8 illustrates a first section of a logic flow diagram of a computer program application for obtaining user data and calculating a remaining cable length on a cable reel.

FIG. 8 illustrates a first section of a logic flow diagram of a computer program application for obtaining user data and calculating a remaining cable length on a cable reel. Aspects of a method 800 for calculating the length of cable remaining on a cable reel will be described in detail, according to an illustrative embodiment. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein.

It also should be understood that the methods disclosed herein can be ended at any time and need not be performed in its entirety. Some or all operations of the methods, and/or substantially equivalent operations, can be performed by execution of computer-readable instructions included on a computer storage media, as defined herein. The term "computer-readable instructions," and variants thereof, as used herein, is used expansively to include routines, applications, application modules, program modules, programs, components, data structures, algorithms, computer program applications and the like. Computer-readable instructions can be implemented on various system configurations including single-processor or multiprocessor systems, minicomputers, mainframe computers, personal computers, hand-held computing devices, microprocessor-based, programmable consumer electronics, combinations thereof, and the like.

Thus, it should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as states, operations, structural devices, acts, or modules. These states, operations, structural devices, acts, and modules may be implemented in software, in firmware, in special purpose digital logic, and any combination thereof. As used herein, the phrase "cause a processor to perform operations" and variants thereof is used to refer to causing a processor of a computing system or device, such as, a CPU 1402 of FIG. 14, devices 1506A-1506N of FIG. 15, or a processor 1602 of FIG. 16, to perform one or more operations and/or causing the processor to direct other components of the computing system or device to perform one or more of the operations.

Figure 14:
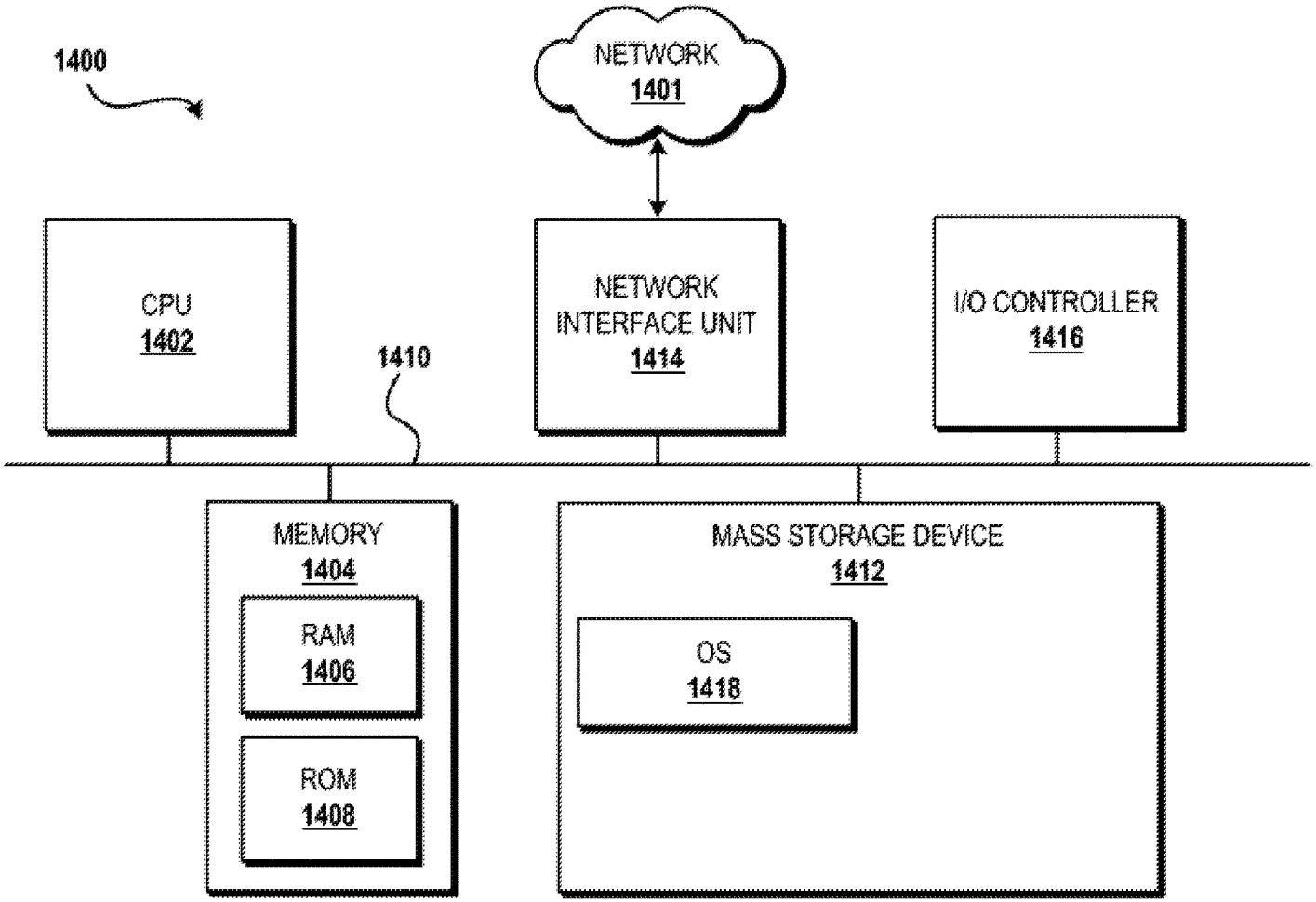
FIG. 14 is a computer architecture diagram illustrating an illustrative computer hardware and software architecture for a computing system capable of implementing aspects of the embodiments presented herein.
Figure 15:
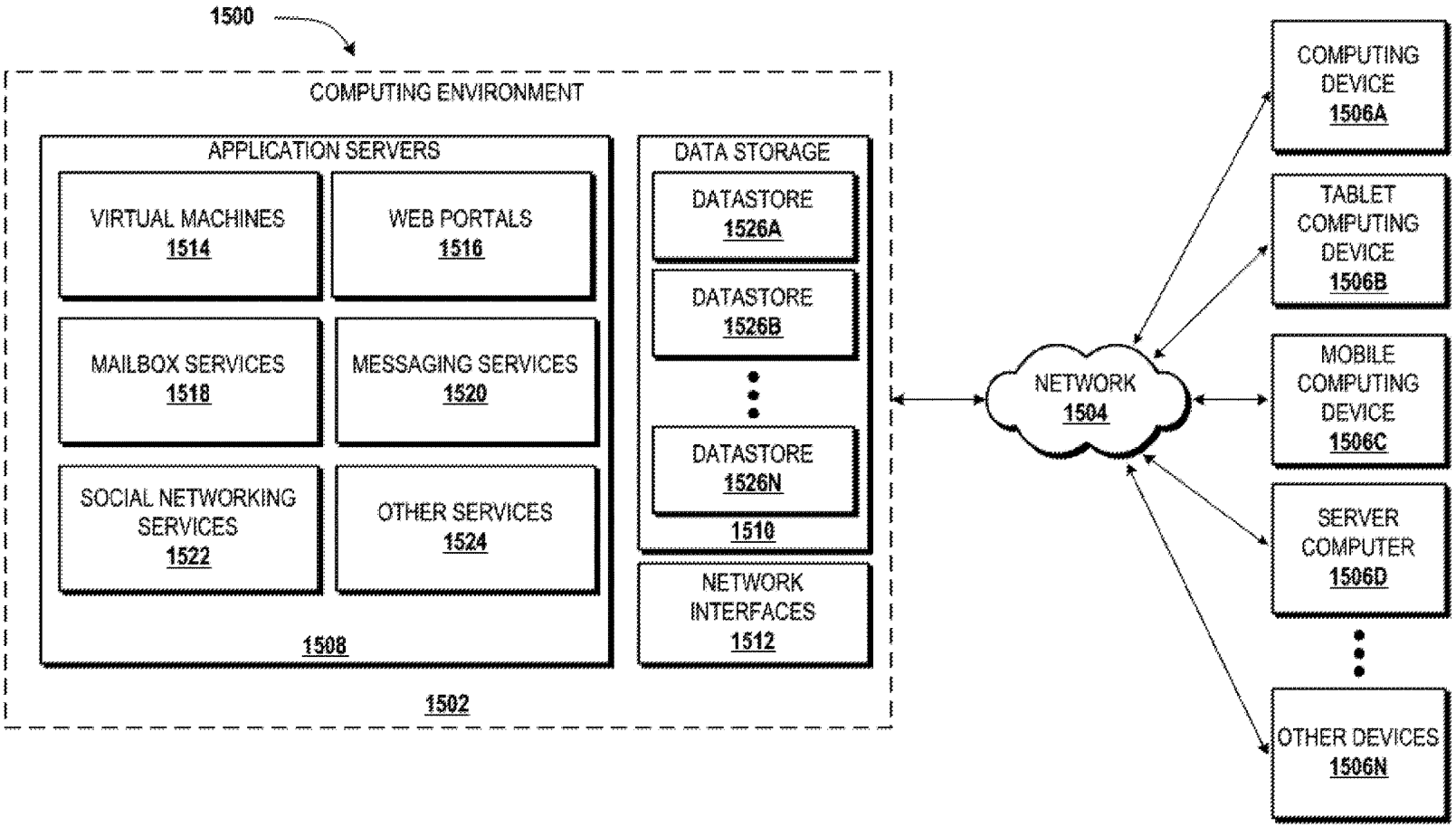
FIG. 15 is a diagram illustrating a distributed computing environment capable of implementing aspects of the embodiments presented herein.
Figure 16:
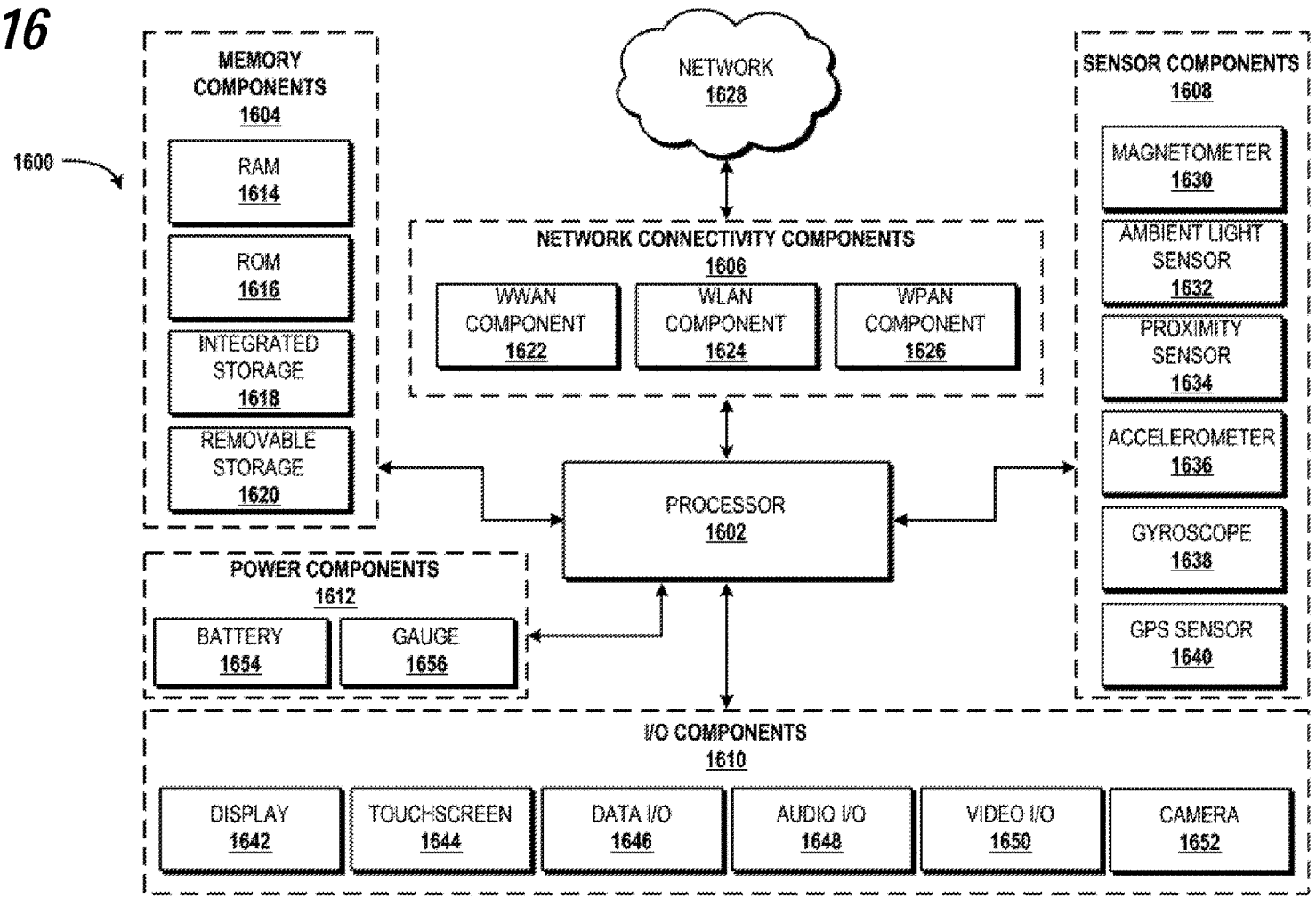
FIG. 16 is a computer architecture diagram illustrating a computing device architecture capable of implementing aspects of the embodiments presented herein.

For purposes of illustrating and describing the concepts of the present disclosure, the methods disclosed herein are described as being performed by the CPU 1402 of FIG. 14, the client devices 1506A-1506N of FIG. 15, or the processor 1602 of FIG. 16, via execution of one or more software modules such as, for example, the program. It should be understood that additional and/or alternative devices and/or network nodes can provide the functionality described herein via execution of one or more modules, applications, and/or other software including, but not limited to, the program. Thus, the illustrated embodiments are illustrative, and should not be viewed as being limiting in any way.

The computer program application starts 802 and prompts for and receives user input 804 on the quantity of cables on the cable reel. This number may be one or more in quantity, and may represent multiple electrical conductors in an electrical conductor assembly. The computer program application then prompts for and receives user input 806 on an outer diameter dimension of each cable of the previously input quantity of cables on the cable reel. The computer program application then prompts for and receives user input 808 on a distance from the top edge of the edge of the cable reel flange to an average depth or height of the remaining wire on the cable reel.

The computer program application then prompts the user to input 810 a characterization of the type of winding on the cable reel the cable is observed to have. For example, the user may be presented with a question on whether the winding of the cable is evenly wound. If the user responds affirmatively, then the computer program application inputs the selection that the wire is evenly would on the cable reel 812. If the user responds negatively, then the computer program application inputs the selection that the wire is unevenly would on the cable reel 814. Based on either response, the computer program application may retrieve different factors based on various parameters of the cable and/or cable reel characteristics to reflect a modification to the calculation of the remaining cable length based on the cable being either evenly or unevenly wound.

Figure 9:
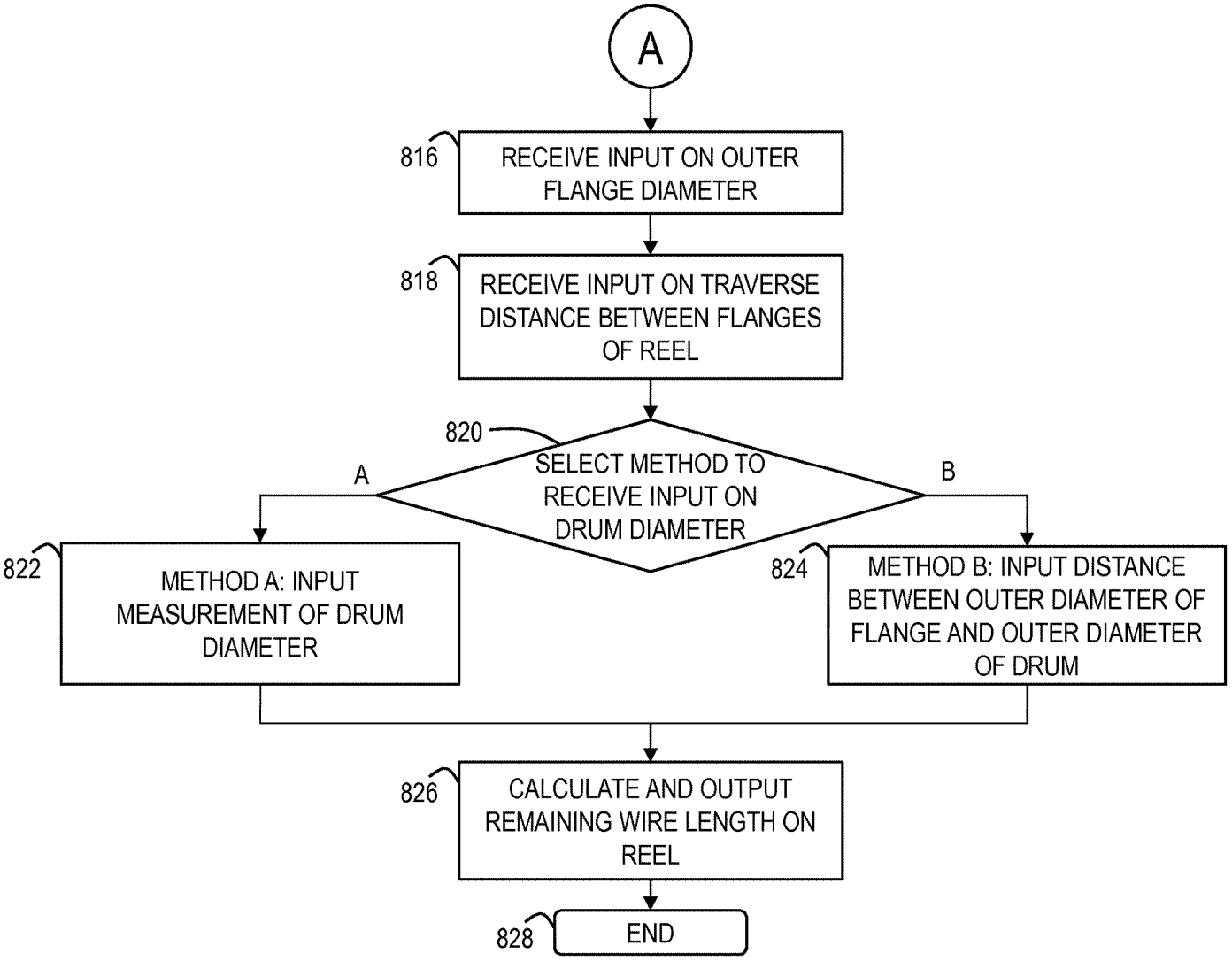
FIG. 9 illustrates a remaining section of the logic flow diagram of the computer program application illustrated in FIG. 8 for obtaining user data and calculating a remaining cable length on a cable reel.

FIG. 9 illustrates a remaining section of the logic flow diagram of the computer program application illustrated in FIG. 8 for obtaining user data and calculating a remaining cable length on a cable reel. The computer program application now turns to entering the dimensions for the cable reel by prompting and receiving user input 816 for the outer flange diameter, the traverse distance 818 between the flanges of the cable reel, and the drum diameter. However, the computer program application prompts the user to input 820 dimensions for the drum diameter based on one of two methods. A first method, "Method A" 822 prompts the user to input a measurement of the drum diameter. This method may be selected when the user knows the dimension of the drum diameter even though cabling may obscure any direct measurement of the drum diameter. A second alternative method, "Method B" 824 prompts the user to input a distance between the outer diameter of the flange and the outer diameter of the drum.

The computer program application then processes all the user input to calculate 826 and output a remaining length of cable on the cable reel based on the equation:

$$\frac{\left[\left[\left(\frac{\pi F^2}{4}\right)-\left(\frac{\pi D^2}{4}\right)\right]T\right]S.F.}{\left(\frac{\pi C^2}{4}\right)}=L$$

Where $F$ = flange diameter;

$D$ = drum diameter;

-continued $T$ = traverse distance of drum between flanges;

$S.F.$ = Scale Factor based on specific cable characteristics;

$C$ = cable diameter;

and $L$ = remaining length of cable on the cable reel.

Where $$\left(\frac{\pi F^2}{4}\right)$$

represents an intermediate product of the area of the flange;

$$\left(\frac{\pi D^2}{4}\right)$$

represents an intermediate product of the area of the drum; and $$\left(\frac{\pi C^2}{4}\right)$$

represents an intermediate product of the area of the cable.

Figure 10:
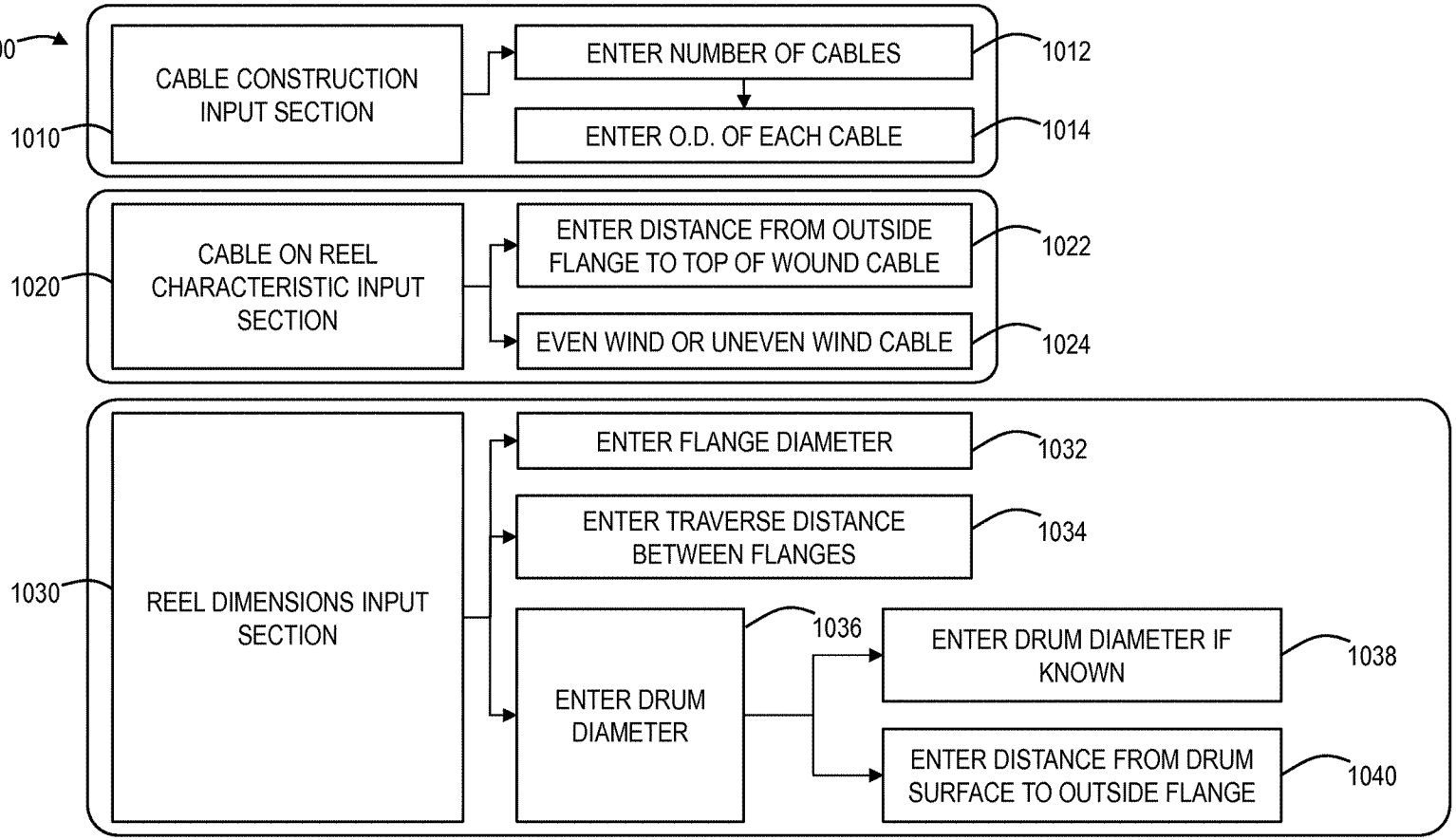
FIG. 10 illustrates a computer program application menu diagram for obtaining and calculating a remaining cable length on a cable reel.

FIG. 10 illustrates a computer program application menu schematic diagram 1000 for obtaining and calculating a remaining cable length on a cable reel based on FIGS. 8-9. A cable construction input section 1010 includes prompting the user to input and obtaining a corresponding number of cables 1012 and the outer diameter of each cable of the previously input number of cables 1014. A cable on cable reel characteristic input section 1020 includes prompting the user to input and obtain a corresponding distance from the outside edge of the flange to the top of the wound cable 1022 and the type of cable winding, 1024, i.e., the characteristic of an even wind or an uneven wind.

A cable reel dimensions input section 1030 includes prompting the user to input and obtain a corresponding flange diameter 1032, traverse distance 1034 between the flanges, and a drum diameter 1036. The drum diameter dimension may be obtained by the user entering the drum diameter directly 1038, or calculated indirectly by the computer program application by the user entering a distance from the outer diameter drum surface to the outside edge of the flange 1040.

Figure 11:
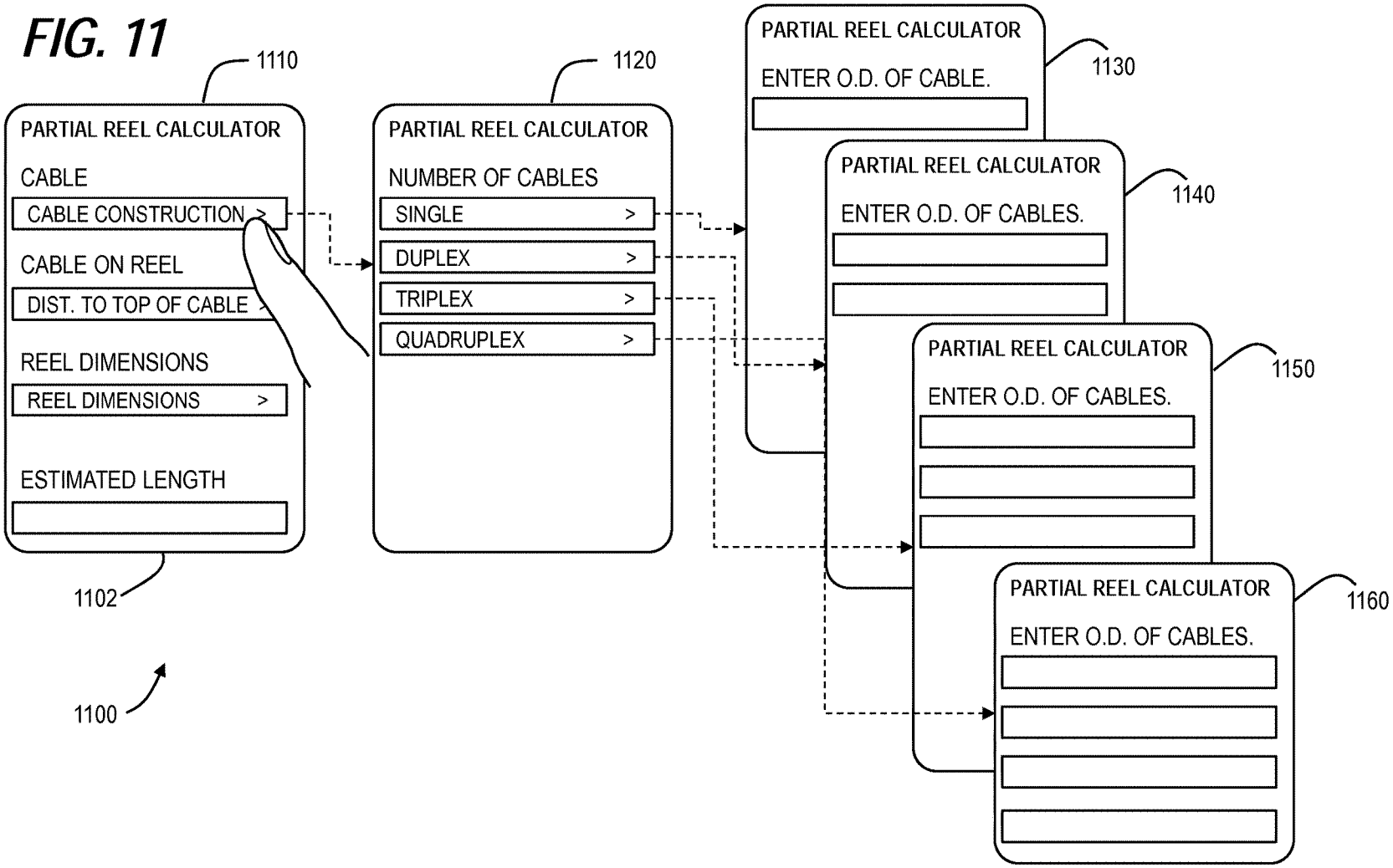
FIG. 11 illustrates a cable construction portion of the computer program application for obtaining user data for calculating a remaining cable length on a cable reel.

FIG. 11 illustrates a cable construction portion 1100 of a computer program application for obtaining user data for calculating a remaining cable length on a cable reel. A progression of screen images of a graphical user interface 1102 on a computing device is illustrated executing an application for calculating a remaining portion of cable on a cable reel. A main menu 1110 illustrates a user selecting via a touch screen of the graphical user interface 1102 a cable construction icon. A number of cables input section 1120 is graphically displayed allowing a user to select between a single, duplex, triplex or a quadruplex configuration of cables on the cable reel. When the single cable icon is selected, the graphical user interface displays a single cable outer diameter input screen 1130 on the user device for the user to enter an outer diameter value for the cable. Likewise, when either the duplex, triplex or quadruplex cable icon is selected by the user in the input section 1120, the graphical user interface displays a corresponding duplex, triplex or quadruplex cable outer diameter input screens 1140, 1150 and 1160, respectively, on the user device for the user to enter an outer diameter value for each of the cables.

Figure 12:
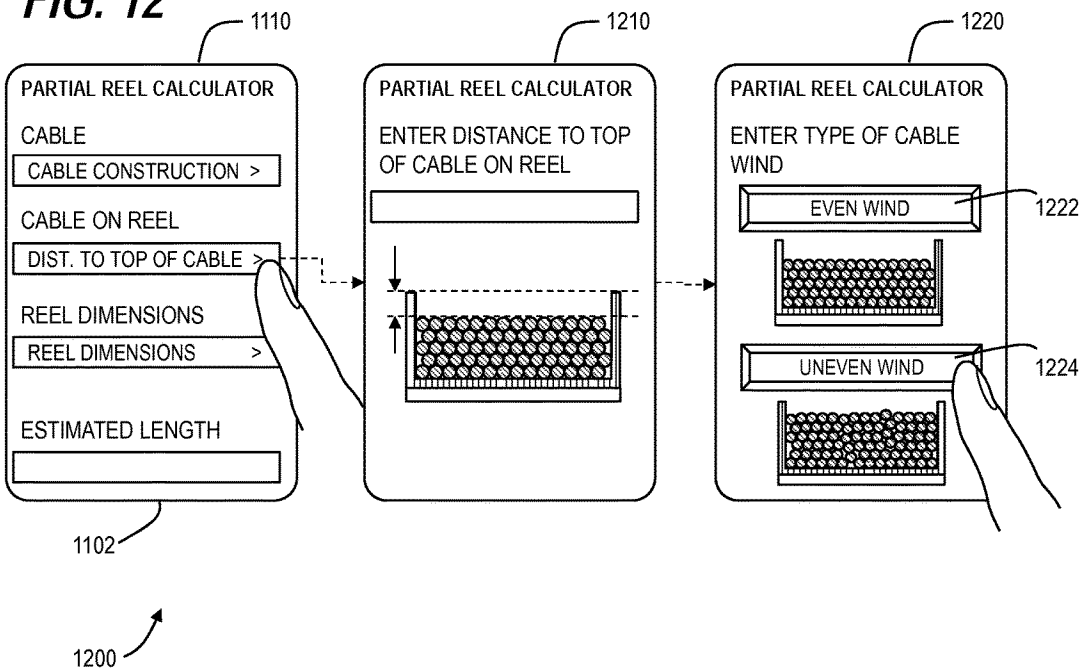
FIG. 12 illustrates a cable on reel portion of the computer program application for obtaining user data for calculating a remaining cable length on a cable reel.

FIG. 12 illustrates a cable on cable reel portion 1200 of the computer program application for obtaining user data for calculating a remaining cable length on a cable reel. The main menu 1110 illustrates a user selecting via a touch screen of the graphical user interface 1102 a cable on the cable reel icon. The user is then prompted to enter a value on a distance to top of cable reel screen 1210 where a graphical representation of the distance indicates the dimension the user is being requested to input. The user is then prompted to select a type of cable wind on the type of cable wind screen 1220, where an icon for an even wind 1222 or an uneven wind 1224 may be selected by the user with graphical representations for each type of winding.

Figure 13:
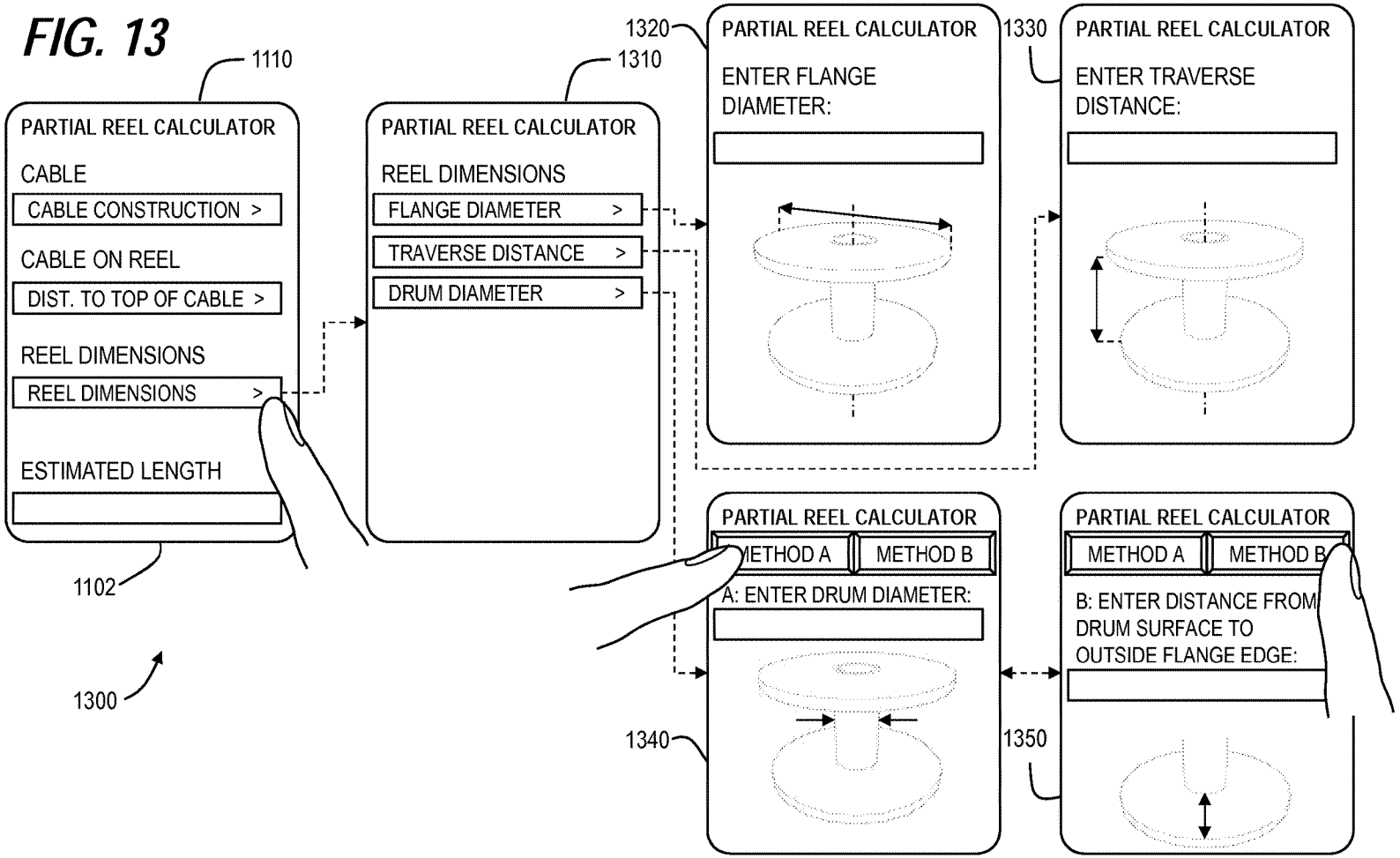
FIG. 13 illustrates a cable reel dimensions portion of the computer program application for obtaining user data for calculating a remaining cable length on a cable reel.

FIG. 13 illustrates a cable reel dimensions portion 1300 of the computer program application for obtaining user data for calculating a remaining cable length on a cable reel. The main menu 1110 illustrates a user selecting via a touch screen of the graphical user interface 1102 a cable reel dimensions icon. A cable reel dimensions graphical menu 1310 is displayed where the user may select to enter a flange diameter in a flange diameter screen 1320, a traverse distance in a traverse distance screen 1330, and a drum diameter where the user may select between two different methods to input the drum diameter dimension. The user is prompted to either enter the drum diameter directly 1340, or enter the distance from the drum surface to the outside edge of the flange 1350 used to calculate the drum diameter based on the flange diameter already entered.

FIG. 14 illustrates exemplary computer architecture 1400 for a device capable of executing the software components described herein for calculating a remaining amount of cable on a cable reel. Thus, the computer architecture 1400 illustrated in FIG. 14 illustrates an architecture for a server computer, mobile phone, a PDA, a smart phone, a desktop computer, a netbook computer, a tablet computer, and/or a laptop computer. The computer architecture 1400 may be utilized to execute any aspects of the software components presented herein.

The computer architecture 1400 illustrated in FIG. 14 includes a central processing unit 1402 ("CPU"), a system memory 1404, including a random access memory 1406 ("RAM") and a read-only memory ("ROM") 1408, and a system bus 1410 that couples the memory 1404 to the CPU 1402. A basic input/output system containing the basic routines that help to transfer information between elements within the computer architecture 1400, such as during startup, is stored in the ROM 1408. The computer architecture 1400 further includes a mass storage device 1412 for storing the operating system 1418 and one or more computer program applications (not illustrated).

The mass storage device 1412 is connected to the CPU 1402 through a mass storage controller (not shown) connected to the bus 1410. The mass storage device 1412 and its associated computer-readable media provide non-volatile storage for the computer architecture 1400. Although the description of computer-readable media contained herein refers to a mass storage device, such as a hard disk or CD-ROM drive, it should be appreciated by those skilled in the art that computer-readable media can be any available computer storage media or communication media that can be accessed by the computer architecture 1400.

Communication media includes computer readable instructions, data structures, program modules, or other data in a modulated data signal such as a carrier wave or other transport mechanism and includes any delivery media. The term "modulated data signal" means a signal that has one or more of its characteristics changed or set in a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

By way of example, and not limitation, computer storage media may include volatile and non-volatile, removable and non-removable media implemented in any method or technology for storage of information such as computer-readable instructions, data structures, program modules or other data. For example, computer media includes, but is not limited to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium that can be used to store the desired information and which can be accessed by the computer architecture 1400. For purposes of the claims, the phrase "computer storage medium," and variations thereof, does not include waves or signals per se and/or communication media.

According to various embodiments, the computer architecture 1400 may operate in a networked environment using logical connections to remote computers through a network such as the network 1401. The computer architecture 1400 may connect to the network 1401 through a network interface unit 1414 connected to the bus 1410. It should be appreciated that the network interface unit 1414 also may be utilized to connect to other types of networks and remote computer systems. The computer architecture 1400 also may include an input/output controller 1416 for receiving and processing input from a number of other devices, including a keyboard, mouse, or electronic stylus (not shown in FIG. 14). Similarly, the input/output controller 1416 may provide output to a display screen, a printer, or other type of output device (also not shown in FIG. 14).

It should be appreciated that the software components described herein may, when loaded into the CPU 1402 and executed, transform the CPU 1402 and the overall computer architecture 1400 from a general-purpose computing system into a special-purpose computing system customized to facilitate the functionality presented herein. The CPU 1402 may be constructed from any number of transistors or other discrete circuit elements, which may individually or collectively assume any number of states. More specifically, the CPU 1402 may operate as a finite-state machine, in response to executable instructions contained within the software modules disclosed herein. These computer-executable instructions may transform the CPU 1402 by specifying how the CPU 1402 transitions between states, thereby transforming the transistors or other discrete hardware elements constituting the CPU 1402.

Encoding the software modules presented herein also may transform the physical structure of the computer-readable media presented herein. The specific transformation of physical structure may depend on various factors, in different implementations of this description. Examples of such factors may include, but are not limited to, the technology used to implement the computer-readable media, whether the computer-readable media is characterized as primary or secondary storage, and the like. For example, if the computer-readable media is implemented as semiconductor-based memory, the software disclosed herein may be encoded on the computer-readable media by transforming the physical state of the semiconductor memory. For example, the software may transform the state of transistors, capacitors, or other discrete circuit elements constituting the semiconductor memory. The software also may transform the physical state of such components in order to store data thereupon.

As another example, the computer-readable media disclosed herein may be implemented using magnetic or optical technology. In such implementations, the software presented herein may transform the physical state of magnetic or optical media, when the software is encoded therein. These transformations may include altering the magnetic characteristics of particular locations within given magnetic media. These transformations also may include altering the physical features or characteristics of particular locations within given optical media, to change the optical characteristics of those locations. Other transformations of physical media are possible without departing from the scope and spirit of the present description, with the foregoing examples provided only to facilitate this discussion.

In light of the above, it should be appreciated that many types of physical transformations take place in the computer architecture 1400 in order to store and execute the software components presented herein. It also should be appreciated that the computer architecture 1400 may include other types of computing devices, including hand-held computers, embedded computer systems, personal digital assistants, and other types of computing devices known to those skilled in the art. It is also contemplated that the computer architecture 1400 may not include all of the components shown in FIG. 14, may include other components that are not explicitly shown in FIG. 14, or may utilize an architecture completely different than that shown in FIG. 14.

FIG. 15 illustrates an illustrative distributed computing environment 1500 capable of executing the software components described herein for calculating a remaining amount of cable on a cable reel. Thus, the distributed computing environment 1500 illustrated in FIG. 15 can be used to provide the functionality described herein with respect to the user computing platform that provides for calculating a remaining amount of cable on a cable reel. The distributed computing environment 1500 thus may be utilized to execute any aspects of the software components presented herein.

According to various implementations, the distributed computing environment 1500 includes a computing environment 1502 operating on, in communication with, or as part of the network 1504. The network 1504 also can include various access networks. One or more client devices 1506A-1506N (hereinafter referred to collectively and/or generically as "clients 1506") can communicate with the computing environment 1502 via the network 1504 and/or other connections (not illustrated in FIG. 15). In the illustrated embodiment, the clients 1506 include a computing device 1506A such as a laptop computer, a desktop computer, or other computing device; a slate or tablet computing device ("tablet computing device") 1506B; a mobile computing device 1506C such as a mobile telephone, a smart phone, or other mobile computing device; a server computer 1506D; and/or other devices 1506N. It should be understood that any number of clients 1506 can communicate with the computing environment 1502. Two example computing architectures for the clients 1506 are illustrated and described herein with reference to FIGS. 14 and 16. It should be understood that the illustrated clients 1506 and computing architectures illustrated and described herein are illustrative, and should not be construed as being limited in any way.

In the illustrated embodiment, the computing environment 1502 includes application servers 1508, data storage 1510, and one or more network interfaces 1512. According to various implementations, the functionality of the application servers 1508 can be provided by one or more server computers that are executing as part of, or in communication with, the network 1504. The application servers 1508 can host various services, virtual machines, portals, and/or other resources. In the illustrated embodiment, the application servers 1508 host one or more virtual machines 1514 for hosting applications or other functionality. According to various implementations, the virtual machines 1514 host one or more applications and/or software modules for providing the functionality described herein for calculating a remaining amount of cable on a cable reel. It should be understood that this embodiment is illustrative, and should not be construed as being limiting in any way. The application servers 1508 also host or provide access to one or more Web portals, link pages, Web sites, and/or other information ("Web portals") 1516.

According to various implementations, the application servers 1508 also include one or more mailbox services 1518 and one or more messaging services 1520. The mailbox services 1518 can include electronic mail ("email") services. The mailbox services 1518 also can include various personal information management ("PIM") services including, but not limited to, calendar services, contact management services, collaboration services, and/or other services. The messaging services 1520 can include, but are not limited to, instant messaging services, chat services, forum services, and/or other communication services.

The application servers 1508 also can include one or more social networking services 1522. The social networking services 1522 can include various social networking services including, but not limited to, services for sharing or posting status updates, instant messages, links, photos, videos, and/or other information; services for commenting or displaying interest in articles, products, blogs, or other resources; and/or other services. In some embodiments, the social networking services 1522 are provided by or include the FACEBOOK social networking service, the LINKEDIN professional networking service, the MYSPACE social networking service, the FOURSQUARE geographic networking service, the YAMMER office colleague networking service, and the like. In other embodiments, the social networking services 1522 are provided by other services, sites, and/or providers that may or may not explicitly be known as social networking providers. For example, some web sites allow users to interact with one another via email, chat services, and/or other means during various activities and/or contexts such as reading published articles, commenting on goods or services, publishing, collaboration, gaming, and the like. Examples of such services include, but are not limited to, the WINDOWS LIVE service and the XBOX LIVE service from Microsoft Corporation in Redmond, Wash. Other services are possible and are contemplated.

The social networking services 1522 also can include commenting, blogging, and/or microblogging services. Examples of such services include, but are not limited to, the YELP commenting service, the KUDZU review service, the OFFICETALK enterprise microblogging service, the TWITTER messaging service, the GOOGLE BUZZ service, and/or other services. It should be appreciated that the above lists of services are not exhaustive and that numerous additional and/or alternative social networking services 1522 are not mentioned herein for the sake of brevity. As such, the above embodiments are illustrative, and should not be construed as being limited in any way.

As shown in FIG. 15, the application servers 1508 also can host other services, applications, portals, and/or other resources ("other services") 1524. The other services 1524 can include, but are not limited to, the application described herein. It thus can be appreciated that the computing environment 1502 can provide integration of the concepts and technologies disclosed herein provided herein for calculating a remaining amount of cable on a cable reel with various mailbox, messaging, social networking, and/or other services or resources. For example, the concepts and technologies disclosed herein may communicate results of the remaining cable length on the cable reel via social networking/mail/messaging/other services.

As mentioned above, the computing environment 1502 can include the data storage 1510. According to various implementations, the functionality of the data storage 1510 is provided by one or more databases operating on, or in communication with, the network 1504. The functionality of the data storage 1510 also can be provided by one or more server computers configured to host data for the computing environment 1502. The data storage 1510 can include, host, or provide one or more real or virtual datastores 1526A-1526N (hereinafter referred to collectively and/or generically as "datastores 1526"). The datastores 1526 are configured to host data used or created by the application servers 1508 and/or other data.

The computing environment 1502 can communicate with, or be accessed by, the network interfaces 1512. The network interfaces 1512 can include various types of network hardware and software for supporting communications between two or more computing devices including, but not limited to, the clients 1506 and the application servers 1508. It should be appreciated that the network interfaces 1512 also may be utilized to connect to other types of networks and/or computer systems.

It should be understood that the distributed computing environment 1500 described herein can provide any aspects of the software elements described herein with any number of virtual computing resources and/or other distributed computing functionality that can be configured to execute any aspects of the software components disclosed herein. According to various implementations of the concepts and technologies disclosed herein, the distributed computing environment 1500 provides the software functionality described herein as a service to the clients 1506. It should be understood that the clients 1506 can include real or virtual machines including, but not limited to, server computers, web servers, personal computers, mobile computing devices, smart phones, and/or other devices. As such, various embodiments of the concepts and technologies disclosed herein enable any device configured to access the distributed computing environment 1500 to utilize the functionality described herein for calculating a remaining amount of cable on a cable reel.

Turning now to FIG. 16, an illustrative computing device architecture 1600 for a computing device that is capable of executing various software components described herein for calculating a remaining amount of cable on a cable reel is provided. The computing device architecture 1600 is applicable to computing devices that facilitate mobile computing due, in part, to form factor, wireless connectivity, and/or battery-powered operation. In some embodiments, the computing devices include, but are not limited to, mobile telephones, tablet devices, slate devices, portable video game devices, and the like. Moreover, the computing device architecture 1600 is applicable to any of the clients 1506 shown in FIG. 15. Furthermore, aspects of the computing device architecture 1600 may be applicable to traditional desktop computers, portable computers (e.g., laptops, notebooks, ultra-portables, and netbooks), server computers, and other computer systems, such as described herein with reference to FIG. 14. For example, the single touch and multi-touch aspects disclosed herein below may be applied to desktop computers that utilize a touchscreen or some other touch-enabled device, such as a touch-enabled track pad or touch-enabled mouse.

The computing device architecture 1600 illustrated in FIG. 16 includes a processor 1602, memory components 1604, network connectivity components 1606, sensor components 1608, input/output components 1610, and power components 1612. In the illustrated embodiment, the processor 1602 is in communication with the memory components 1604, the network connectivity components 1606, the sensor components 1608, the input/output ("I/O") components 1610, and the power components 1612. Although no connections are shown between the individuals components illustrated in FIG. 16, the components can interact to carry out device functions. In some embodiments, the components are arranged so as to communicate via one or more busses (not shown).

The processor 1602 includes a central processing unit ("CPU") configured to process data, execute computer-executable instructions of one or more computer program applications, and communicate with other components of the computing device architecture 1600 in order to perform various functionality described herein. The processor 1602 may be utilized to execute aspects of the software components presented herein and, particularly, those that utilize, at least in part, a touch-enabled input.

In some embodiments, the processor 1602 includes a graphics processing unit ("GPU") configured to accelerate operations performed by the CPU, including, but not limited to, operations performed by executing general-purpose scientific and engineering computing applications, as well as graphics-intensive computing applications such as high resolution video (e.g., 720P, 1080P, and greater), video games, three-dimensional ("D") modeling applications, and the like. In some embodiments, the processor 1602 is configured to communicate with a discrete GPU (not shown). In any case, the CPU and GPU may be configured in accordance with a co-processing CPU/GPU computing model, wherein the sequential part of an application executes on the CPU and the computationally-intensive part is accelerated by the GPU.

In some embodiments, the processor 1602 is, or is included in, a system-on-chip ("SoC") along with one or more of the other components described herein below. For example, the SoC may include the processor 1602, a GPU, one or more of the network connectivity components 1606, and one or more of the sensor components 1608. In some embodiments, the processor 1602 is fabricated, in part, utilizing a package-on-package ("PoP") integrated circuit packaging technique. Moreover, the processor 1602 may be a single core or multi-core processor.

The processor 1602 may be created in accordance with an ARM architecture, available for license from ARM HOLDINGS of Cambridge, United Kingdom. Alternatively, the processor 1602 may be created in accordance with an x86 architecture, such as is available from INTEL CORPORATION of Mountain View, Calif. and others. In some embodiments, the processor 1602 is a SNAPDRAGON SoC, available from QUALCOMM of San Diego, Calif., a TEGRA SoC, available from NVIDIA of Santa Clara, Calif., a HUMMINGBIRD SoC, available from SAMSUNG of Seoul, South Korea, an Open Multimedia Application Platform ("OMAP") SoC, available from TEXAS INSTRUMENTS of Dallas, Tex., a customized version of any of the above SoCs, or a proprietary SoC.

The memory components 1604 include a random access memory ("RAM") 1614, a read-only memory ("ROM") 1616, an integrated storage memory ("integrated storage") 1618, and a removable storage memory ("removable storage") 1620. In some embodiments, the RAM 1614 or a portion thereof, the ROM 1616 or a portion thereof, and/or some combination the RAM 1614 and the ROM 1616 is integrated in the processor 1602. In some embodiments, the ROM 1616 is configured to store a firmware, an operating system or a portion thereof (e.g., operating system kernel), and/or a bootloader to load an operating system kernel from the integrated storage 1618 or the removable storage 1620.

The integrated storage 1618 can include a solid-state memory, a hard disk, or a combination of solid-state memory and a hard disk. The integrated storage 1618 may be soldered or otherwise connected to a logic board upon which the processor 1602 and other components described herein also may be connected. As such, the integrated storage 1618 is integrated in the computing device. The integrated storage 1618 is configured to store an operating system or portions thereof, computer program applications, data, and other software components described herein.

The removable storage 1620 can include a solid-state memory, a hard disk, or a combination of solid-state memory and a hard disk. In some embodiments, the removable storage 1620 is provided in lieu of the integrated storage 1618. In other embodiments, the removable storage 1620 is provided as additional optional storage. In some embodiments, the removable storage 1620 is logically combined with the integrated storage 1618 such that the total available storage is made available and shown to a user as a total combined capacity of the integrated storage 1618 and the removable storage 1620.

The removable storage 1620 is configured to be inserted into a removable storage memory slot (not shown) or other mechanism by which the removable storage 1620 is inserted and secured to facilitate a connection over which the removable storage 1620 can communicate with other components of the computing device, such as the processor 1602. The removable storage 1620 may be embodied in various memory card formats including, but not limited to, PC card, CompactFlash card, memory stick, secure digital ("SD"), miniSD, microSD, universal integrated circuit card ("UICC") (e.g., a subscriber identity module ("SIM") or universal SIM ("USIM")), a proprietary format, or the like.

It can be understood that one or more of the memory components 1604 can store an operating system. According to various embodiments, the operating system includes, but is not limited to, SYMBIAN OS from SYMBIAN LIMITED, WINDOWS MOBILE OS from Microsoft Corporation of Redmond, Wash., WINDOWS PHONE OS from Microsoft Corporation, WINDOWS from Microsoft Corporation, PALM WEBOS from Hewlett-Packard Company of Palo Alto, Calif., BLACKBERRY OS from Research In Motion Limited of Waterloo, Ontario, Canada, IOS from Apple Inc. of Cupertino, Calif., and ANDROID OS from Google Inc. of Mountain View, Calif. Other operating systems are contemplated.

The network connectivity components 1606 include a wireless wide area network component ("WWAN component") 1622, a wireless local area network component ("WLAN component") 1624, and a wireless personal area network component ("WPAN component") 1626. The network connectivity components 1606 facilitate communications to and from a network 1628, which may be a WWAN, a WLAN, or a WPAN. Although a single network 1628 is illustrated, the network connectivity components 1606 may facilitate simultaneous communication with multiple networks. For example, the network connectivity components 1606 may facilitate simultaneous communications with multiple networks via one or more of a WWAN, a WLAN, or a WPAN.

The network 1628 may be a WWAN, such as a mobile telecommunications network utilizing one or more mobile telecommunications technologies to provide voice and/or data services to a computing device utilizing the computing device architecture 1600 via the WWAN component 1622. The mobile telecommunications technologies can include, but are not limited to, Global System for Mobile communications ("GSM"), Code Division Multiple Access ("CDMA") ONE, CDMA2000, Universal Mobile Telecommunications System ("UMTS"), Long Term Evolution ("LTE"), and Worldwide Interoperability for Microwave Access ("WiMAX"). Moreover, the network 1628 may utilize various channel access methods (which may or may not be used by the aforementioned standards) including, but not limited to, Time Division Multiple Access ("TDMA"), Frequency Division Multiple Access ("FDMA"), CDMA, wideband CDMA ("W-CDMA"), Orthogonal Frequency Division Multiplexing ("OFDM"), Space Division Multiple Access ("SDMA"), and the like. Data communications may be provided using General Packet Radio Service ("GPRS"), Enhanced Data rates for Global Evolution ("EDGE"), the High-Speed Packet Access ("HSPA") protocol family including High-Speed Downlink Packet Access ("HSDPA"), Enhanced Uplink ("EUL") or otherwise termed High-Speed Uplink Packet Access ("HSUPA"), Evolved HSPA ("HSPA+"), LTE, and various other current and future wireless data access standards. The network 1628 may be configured to provide voice and/or data communications with any combination of the above technologies. The network 1628 may be configured to or adapted to provide voice and/or data communications in accordance with future generation technologies.

In some embodiments, the WWAN component 1622 is configured to provide dual-multi-mode connectivity to the network 1628. For example, the WWAN component 1622 may be configured to provide connectivity to the network 1628, wherein the network 1628 provides service via GSM and UMTS technologies, or via some other combination of technologies. Alternatively, multiple WWAN components 1622 may be utilized to perform such functionality, and/or provide additional functionality to support other non-compatible technologies (i.e., incapable of being supported by a single WWAN component). The WWAN component 1622 may facilitate similar connectivity to multiple networks (e.g., a UMTS network and an LTE network).

The network 1628 may be a WLAN operating in accordance with one or more Institute of Electrical and Electronic Engineers ("IEEE") 802.11 standards, such as IEEE 802.11a, 802.11b, 802.11g, 802.11n, and/or future 802.11 standard (referred to herein collectively as WI-FI). Draft 802.11 standards are also contemplated. In some embodiments, the WLAN is implemented utilizing one or more wireless WI-FI access points. In some embodiments, one or more of the wireless WI-FI access points are another computing device with connectivity to a WWAN that are functioning as a WI-FI hotspot. The WLAN component 1624 is configured to connect to the network 1628 via the WI-FI access points. Such connections may be secured via various encryption technologies including, but not limited, WI-FI Protected Access ("WPA"), WPA2, Wired Equivalent Privacy ("WEP"), and the like.

The network 1628 may be a WPAN operating in accordance with Infrared Data Association ("IrDA"), BLUETOOTH, wireless Universal Serial Bus ("USB"), Z-Wave, ZIGBEE, or some other short-range wireless technology. In some embodiments, the WPAN component 1626 is configured to facilitate communications with other devices, such as peripherals, computers, or other computing devices via the WPAN.

The sensor components 1608 include a magnetometer 1630, an ambient light sensor 1632, a proximity sensor 1634, an accelerometer 1636, a gyroscope 1638, and a Global Positioning System sensor ("GPS sensor") 1640. It is contemplated that other sensors, such as, but not limited to, temperature sensors or shock detection sensors, also may be incorporated in the computing device architecture 1600.

The magnetometer 1630 is configured to measure the strength and direction of a magnetic field. In some embodiments the magnetometer 1630 provides measurements to a compass application program stored within one of the memory components 1604 in order to provide a user with accurate directions in a frame of reference including the cardinal directions, north, south, east, and west. Similar measurements may be provided to a navigation application program that includes a compass component. Other uses of measurements obtained by the magnetometer 1630 are contemplated.

The ambient light sensor 1632 is configured to measure ambient light. In some embodiments, the ambient light sensor 1632 provides measurements to a computer program application stored within one the memory components 1604 in order to automatically adjust the brightness of a display (described below) to compensate for low-light and high-light environments. Other uses of measurements obtained by the ambient light sensor 1632 are contemplated.

The proximity sensor 1634 is configured to detect the presence of an object or thing in proximity to the computing device without direct contact. In some embodiments, the proximity sensor 1634 detects the presence of a user's body (e.g., the user's face) and provides this information to a computer program application stored within one of the memory components 1604 that utilizes the proximity information to enable or disable some functionality of the computing device. For example, a telephone application program may automatically disable a touchscreen (described below) in response to receiving the proximity information so that the user's face does not inadvertently end a call or enable/disable other functionality within the telephone computer program application during the call. Other uses of proximity as detected by the proximity sensor 1634 are contemplated.

The accelerometer 1636 is configured to measure proper acceleration. In some embodiments, output from the accelerometer 1636 is used by a computer program application as an input mechanism to control some functionality of the computer program application. For example, the computer program application may be a video game in which a character, a portion thereof, or an object is moved or otherwise manipulated in response to input received via the accelerometer 1636. In some embodiments, output from the accelerometer 1636 is provided to a computer program application for use in switching between landscape and portrait modes, calculating coordinate acceleration, or detecting a fall. Other uses of the accelerometer 1636 are contemplated.

The gyroscope 1638 is configured to measure and maintain orientation. In some embodiments, output from the gyroscope 1638 is used by a computer program application as an input mechanism to control some functionality of the computer program application. For example, the gyroscope 1638 can be used for accurate recognition of movement within a 3D environment of a video game application or some other application. In some embodiments, a computer program application utilizes output from the gyroscope 1638 and the accelerometer 1636 to enhance control of some functionality of the computer program application. Other uses of the gyroscope 1638 are contemplated.

The GPS sensor 1640 is configured to receive signals from GPS satellites for use in calculating a location. The location calculated by the GPS sensor 1640 may be used by any computer program application that requires or benefits from location information. For example, the location calculated by the GPS sensor 1640 may be used with a navigation application program to provide directions from the location to a destination or directions from the destination to the location. Moreover, the GPS sensor 1640 may be used to provide location information to an external location-based service, such as E911 service. The GPS sensor 1640 may obtain location information generated via WI-FI, WIMAX, and/or cellular triangulation techniques utilizing one or more of the network connectivity components 1606 to aid the GPS sensor 1640 in obtaining a location fix. The GPS sensor 1640 may also be used in Assisted GPS ("A-GPS") systems.

The I/O components 1610 include a display 1642, a touchscreen 1644, a data I/O interface component ("data I/O") 1646, an audio I/O interface component ("audio I/O") 1648, a video I/O interface component ("video I/O") 1650, and a camera 1652. In some embodiments, the display 1642 and the touchscreen 1644 are combined. In some embodiments two or more of the data I/O component 1646, the audio I/O component 1648, and the video I/O component 1650 are combined. The I/O components 1610 may include discrete processors configured to support the various interface described below, or may include processing functionality built-in to the processor 1602.

The display 1642 is an output device configured to present information in a visual form. In particular, the display 1642 may present graphical user interface ("GUI") elements, text, images, video, notifications, virtual buttons, virtual keyboards, messaging data, Internet content, device status, time, date, calendar data, preferences, map information, location information, and any other information that is capable of being presented in a visual form. In some embodiments, the display 1642 is a liquid crystal display ("LCD") utilizing any active or passive matrix technology and any backlighting technology (if used). In some embodiments, the display 1642 is an organic light emitting diode ("OLED") display. Other display types are contemplated.

The touchscreen 1644 is an input device configured to detect the presence and location of a touch. The touchscreen 1644 may be a resistive touchscreen, a capacitive touchscreen, a surface acoustic wave touchscreen, an infrared touchscreen, an optical imaging touchscreen, a dispersive signal touchscreen, an acoustic pulse recognition touchscreen, or may utilize any other touchscreen technology. In some embodiments, the touchscreen 1644 is incorporated on top of the display 1642 as a transparent layer to enable a user to use one or more touches to interact with objects or other information presented on the display 1642. In other embodiments, the touchscreen 1644 is a touch pad incorporated on a surface of the computing device that does not include the display 1642. For example, the computing device may have a touchscreen incorporated on top of the display 1642 and a touch pad on a surface opposite the display 1642.

In some embodiments, the touchscreen 1644 is a single-touch touchscreen. In other embodiments, the touchscreen 1644 is a multi-touch touchscreen. In some embodiments, the touchscreen 1644 is configured to detect discrete touches, single touch gestures, and/or multi-touch gestures. These are collectively referred to herein as gestures for convenience. Several gestures will now be described. It should be understood that these gestures are illustrative and are not intended to limit the scope of the appended claims. Moreover, the described gestures, additional gestures, and/or alternative gestures may be implemented in software for use with the touchscreen 1644. As such, a developer may create gestures that are specific to a particular computer program application.

In some embodiments, the touchscreen 1644 supports a tap gesture in which a user taps the touchscreen 1644 once on an item presented on the display 1642. The tap gesture may be used for various reasons including, but not limited to, opening or launching whatever the user taps. In some embodiments, the touchscreen 1644 supports a double tap gesture in which a user taps the touchscreen 1644 twice on an item presented on the display 1642. The double tap gesture may be used for various reasons including, but not limited to, zooming in or zooming out in stages. In some embodiments, the touchscreen 1644 supports a tap and hold gesture in which a user taps the touchscreen 1644 and maintains contact for at least a pre-defined time. The tap and hold gesture may be used for various reasons including, but not limited to, opening a context-specific menu.

In some embodiments, the touchscreen 1644 supports a pan gesture in which a user places a finger on the touchscreen 1644 and maintains contact with the touchscreen 1644 while moving the finger on the touchscreen 1644. The pan gesture may be used for various reasons including, but not limited to, moving through screens, images, or menus at a controlled rate. Multiple finger pan gestures are also contemplated. In some embodiments, the touchscreen 1644 supports a flick gesture in which a user swipes a finger in the direction the user wants the screen to move. The flick gesture may be used for various reasons including, but not limited to, scrolling horizontally or vertically through menus or pages. In some embodiments, the touchscreen 1644 supports a pinch and stretch gesture in which a user makes a pinching motion with two fingers (e.g., thumb and forefinger) on the touchscreen 1644 or moves the two fingers apart. The pinch and stretch gesture may be used for various reasons including, but not limited to, zooming gradually in or out of a website, map, or picture.

Although the above gestures have been described with reference to the use one or more fingers for performing the gestures, other appendages such as toes or objects such as styluses may be used to interact with the touchscreen 1644. As such, the above gestures should be understood as being illustrative and should not be construed as being limiting in any way.

The data I/O interface component 1646 is configured to facilitate input of data to the computing device and output of data from the computing device. In some embodiments, the data I/O interface component 1646 includes a connector configured to provide wired connectivity between the computing device and a computer system, for example, for synchronization operation purposes. The connector may be a proprietary connector or a standardized connector such as USB, micro-USB, mini-USB, or the like. In some embodiments, the connector is a dock connector for docking the computing device with another device such as a docking station, audio device (e.g., a digital music player), or video device.

The audio I/O interface component 1648 is configured to provide audio input and/or output capabilities to the computing device. In some embodiments, the audio I/O interface component 1648 includes a microphone configured to collect audio signals. In some embodiments, the audio I/O interface component 1648 includes a headphone jack configured to provide connectivity for headphones or other external speakers. In some embodiments, the audio interface component 1648 includes a speaker for the output of audio signals. In some embodiments, the audio I/O interface component 1648 includes an optical audio cable out.

The video I/O interface component 1650 is configured to provide video input and/or output capabilities to the computing device. In some embodiments, the video I/O interface component 1650 includes a video connector configured to receive video as input from another device (e.g., a video media player such as a DVD or BLURAY player) or send video as output to another device (e.g., a monitor, a television, or some other external display). In some embodiments, the video I/O interface component 1650 includes a High-Definition Multimedia Interface ("HDMI"), mini-HDMI, micro-HDMI, DisplayPort, or proprietary connector to input/output video content. In some embodiments, the video I/O interface component 1650 or portions thereof is combined with the audio I/O interface component 1648 or portions thereof The camera 1652 can be configured to capture still images and/or video. The camera 1652 may utilize a charge coupled device ("CCD") or a complementary metal oxide semiconductor ("CMOS") image sensor to capture images. In some embodiments, the camera 1652 includes a flash to aid in taking pictures in low-light environments. Settings for the camera 1652 may be implemented as hardware or software buttons.

Although not illustrated, one or more hardware buttons may also be included in the computing device architecture 1600. The hardware buttons may be used for controlling some operational aspect of the computing device. The hardware buttons may be dedicated buttons or multi-use buttons. The hardware buttons may be mechanical or sensor-based.

The illustrated power components 1612 include one or more batteries 1654, which can be connected to a battery gauge 1656. The batteries 1654 may be rechargeable or disposable. Rechargeable battery types include, but are not limited to, lithium polymer, lithium ion, nickel cadmium, and nickel metal hydride. Each of the batteries 1654 may be made of one or more cells.

The battery gauge 1656 can be configured to measure battery parameters such as current, voltage, and temperature. In some embodiments, the battery gauge 1656 is configured to measure the effect of a battery's discharge rate, temperature, age and other factors to predict remaining life within a certain percentage of error. In some embodiments, the battery gauge 1656 provides measurements to a computer program application that is configured to utilize the measurements to present useful power management data to a user. Power management data may include one or more of a percentage of battery used, a percentage of battery remaining, a battery condition, a remaining time, a remaining capacity (e.g., in watt hours), a current draw, and a voltage.

The power components 1612 may also include a power connector, which may be combined with one or more of the aforementioned I/O components 1610. The power components 1612 may interface with an external power system or charging equipment via a power I/O component.

Based on the foregoing, it should be appreciated that technologies for calculating a remaining amount of cable on a cable reel have been disclosed herein. Although the subject matter presented herein has been described in language specific to computer structural features, methodological and transformative acts, specific computing machinery, and computer readable media, it is to be understood that the invention defined in the appended claims is not necessarily limited to the specific features, acts, or media described herein. Rather, the specific features, acts and mediums are disclosed as example forms of implementing the claims.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A method for calculating a remaining length of a cable on a cable reel, the method comprising:

causing, by a processor of a computing device, a first screen of at least one graphical user interface to be displayed on a display of the computing device;

receiving, at the processor, via the first screen of the at least one graphical user interface, a first input of a first distance between an edge of a first flange of the cable reel and a top portion of the cable remaining on the cable reel, wherein the first input is received on a touchscreen associated with the display of the computing device;

processing, by the processor, the first input to determine a second screen of the at least one graphical user interface to cause to be displayed;

causing, by the processor, the second screen of the at least one graphical user interface to be displayed on the display of the computing device;

receiving, at the processor, via the second screen of the at least one graphical user interface, a second input of a winding characterization indicating how the cable is wound on the cable reel, wherein the second input is received on the touchscreen associated with the display of the computing device;

determining, by the processor, based at least in part on the winding characterization, a factor;

receiving, at the processor, via at least one third screen of the at least one graphical user interface, a third input of dimensions of the cable reel, the dimensions of the cable reel comprising:

a diameter of the first flange, a cable reel traverse distance indicating a distance between the first flange and a second flange of the cable reel, and one of a diameter of a drum of the cable reel or a distance between an outer diameter of the drum of the cable reel and the edge of the first flange; and calculating, by the processor, the remaining length of the cable on the cable reel based, at least in part, on the first distance, the factor, and the dimensions of the cable reel.

2. The method of claim 1, wherein the winding characterization is one of a plurality of winding characterizations provided via the second screen of the at least one graphical user interface.

3. The method of claim 2, wherein the plurality of winding characterizations comprises:

an even cable wind characterization indicating that the cable is wound on the cable reel in a manner where spaces between adjacent portions of the cable wound on the cable reel are minimized, and an uneven cable wind characterization indicating that the cable is wound on the cable reel in a manner where the spaces between the adjacent portions of the cable wound on the cable reel are not minimized.

4. The method of claim 1, wherein the factor is further based on characteristics of the cable remaining on the cable reel.

5. The method of claim 4, wherein the characteristics of the cable remaining on the cable reel comprise an outer diameter dimension of the cable remaining on the cable reel.

6. The method of claim 4, wherein the characteristics of the cable remaining on the cable reel comprise a type of the cable remaining on the cable reel.

7. The method of claim 1, wherein in response to receiving the distance between the outer diameter of the drum of the cable reel and the edge of the first flange, calculating, by the processor, the diameter of the drum of the cable reel indirectly using the distance between the outer diameter of the drum of the cable reel and the edge of the first flange.

8. The method of claim 1, wherein the cable comprises an assembly of cables, wherein the at least one graphical user interface provides a first prompt for receiving a number of the cables on the cable reel and a second prompt for receiving an outer diameter dimension for each of the cables on the cable reel, and wherein the at least one graphical user interface displays the remaining length for the cable on the cable reel.

9. A system for calculating a remaining length of a cable on a cable reel, the system comprising:

a display;

a processor; and a memory that stores instructions that, when executed by the processor, cause the processor to perform operations comprising:

causing a first screen of at least one graphical user interface to be displayed on the display, receiving, via the first screen of the at least one graphical user interface, a first input of a first distance between an edge of a first flange of the cable reel and a top portion of the cable remaining on the cable reel, wherein the first input is received on a touchscreen associated with the display, processing the first input to determine a second screen of the at least one graphical user interface to cause to be displayed, causing the second screen of the at least one graphical user interface to be displayed on the display, receiving, via the second screen of the at least one graphical user interface, a second input of a winding characterization indicating how the cable is wound on the cable reel, wherein the second input is received on the touchscreen associated with the display, determining, based at least in part on the winding characterization, a factor, receiving, via at least one third screen of the at least one graphical user interface, a third input of dimensions of the cable reel, the dimensions comprising:

a diameter of the first flange, a cable reel traverse distance between the first flange and a second flange of the cable reel, and one of a diameter of a drum of the cable reel or a distance between an outer diameter of the drum of the cable reel and the edge of the first flange, and calculating the remaining length of the cable on the cable reel based, at least in part, on the first distance, the factor, and the cable reel dimensions.

10. The system of claim 9, wherein the cable on the cable reel comprises an assembly of cables, and wherein the at least one graphical user interface provides a first prompt for receiving a number of the cables on the cable reel and a second prompt for receiving an outer diameter dimension for each of the cables on the cable reel.

11. The system of claim 9, wherein the winding characterization is one of a plurality of winding characterizations provided via the second screen of the at least one graphical user interface, and wherein the plurality of winding characterizations comprises:

an even cable wind characterization indicating that the cable is wound on the cable reel such that spaces between adjacent portions of the cable wound on the cable reel are minimized, and an uneven cable wind characterization indicating that the cable is wound on the cable reel such that the spaces between the adjacent portions of the cable wound on the cable reel are not minimized.

12. The system of claim 9, wherein the operations further comprise displaying, via the at least one graphical user interface, the remaining length of the cable on the cable reel to a user device.

13. The system of claim 9, wherein the factor is further based on characteristics of the cable remaining on the cable reel, wherein the characteristics of the cable remaining on the cable reel comprise an outer diameter dimension of the cable remaining on the cable reel.

14. The system of claim 13, wherein the characteristics of the cable remaining on the cable reel further comprise a type of the cable remaining on the cable reel.

15. The system of claim 9, wherein in response to receiving the distance between the outer diameter of the drum of the cable reel and the edge of the first flange, calculating the diameter of the drum of the cable reel indirectly using the distance between the outer diameter of the drum of the cable reel and the edge of the first flange.

16. A computer storage medium having computer-executable instructions stored thereon that, when executed by a processor of a computing device, cause the processor to perform operations comprising:

causing a first screen of at least one graphical user interface to be displayed on a display of the computing device;

receiving, via the first screen of the at least one graphical user interface, a first input of a first distance between an edge of a first flange of a cable reel and a top portion of a cable remaining on the cable reel, wherein the first input is received on a touchscreen associated with the display of the computing device;

processing the first input to determine a second screen of the at least one graphical user interface to cause to be displayed;

causing the second screen of the at least one graphical user interface to be displayed on the display of the computing device;

receiving, via the second screen of the at least one graphical user interface, a second input of a winding characterization indicating how the cable is wound on the cable reel, wherein the second input is received on the touchscreen associated with the display of the computing device;

determining, based at least in part on the winding characterization, a factor;

receiving, via at least one third screen of the at least one graphical user interface, a third input of dimensions of the cable reel, the dimensions of the cable reel comprising:

a diameter of the first flange, a cable reel traverse distance between the first flange and a second flange of the cable reel, and one of a diameter of a cable reel drum or a distance between an outer diameter of the cable reel drum of the cable reel and the edge of the first flange; and calculating a remaining length of the cable on the cable reel based, at least in part, on the first distance, the factor, and the dimensions of the cable reel.

17. The computer storage medium of claim 16, wherein the cable comprises an assembly of cables, wherein the at least one graphical user interface provides a first prompt for receiving a quantity of the cables on the cable reel and a second prompt for receiving an outer diameter dimension for each of the cables on the cable reel, and wherein the at least one graphical user interface displays the remaining length for the cable on the cable reel.

18. The computer storage medium of claim 16, wherein the factor is further based on characteristics of the cable remaining on the cable reel.

19. The computer storage medium of claim 18, wherein the characteristics of the cable remaining on the cable reel comprise an outer diameter dimension for the cable remaining on the cable reel.

20. The computer storage medium of claim 18, wherein the characteristics of the cable remaining on the cable reel comprise a type of the cable remaining on the cable reel.

* * * * *